US007616127B2

(12) United States Patent
Sorenson, Jr. et al.

(10) Patent No.: US 7,616,127 B2
(45) **Date of Patent: *Nov. 10, 2009**

(54) REMOVABLE MOUNT FOR MOUNTING AN ELECTRONIC SYSTEM COMPONENT ON A FORKLIFT

(75) Inventors: Richard W. Sorenson, Jr., Atlanta, GA (US); Ernest Lee Son, Roswell, GA (US); Paul Edward Wiesner, Lawrenceville, GA (US); William H. Roeder, Norcross, GA (US); Michael Sayre Clott, Marietta, GA (US)

(73) Assignee: EMS Technologies, Inc., Norcross, GA (US)

( * ) Notice: Subject to any disclaimer, the term of this patent is extended or adjusted under 35 U.S.C. 154(b) by 484 days.

This patent is subject to a terminal disclaimer.

(21) Appl. No.: 11/369,005

(22) Filed: Mar. 7, 2006

(65) Prior Publication Data

US 2007/0096922 A1 May 3, 2007

Related U.S. Application Data

(60) Provisional application No. 60/733,295, filed on Nov. 3, 2005.

(51) Int. Cl.
*G08B 23/00* (2006.01)

(52) U.S. Cl. ..... 340/693.9; 340/572.7; 340/572.8

(58) Field of Classification Search ..... 340/572.7, 340/572.8, 693.9, 5.92; 235/385; 705/28; 361/679, 728

See application file for complete search history.

(56) References Cited

U.S. PATENT DOCUMENTS 4,771,288 A 9/1988 Johnson
5,604,485 A 2/1997 Lauro et al.
5,608,417 A 3/1997 de Vall
5,729,697 A 3/1998 Schkolnick et al.
6,057,765 A 5/2000 Jones et al.
6,166,638 A * 12/2000 Brady et al. ..... 340/572.7
6,332,098 B2 12/2001 Ross et al.
6,496,806 B1 12/2002 Horwitz et al.
6,600,418 B2 7/2003 Francis et al.
6,669,089 B2 * 12/2003 Cybulski et al. ..... 235/385
6,703,935 B1 3/2004 Chung et al.
6,750,771 B1 6/2004 Brand
6,788,204 B1 9/2004 Ianelli et al.
6,809,703 B2 10/2004 Serra
7,036,734 B2 5/2006 Baker
7,121,457 B2 10/2006 Michal, III
7,151,979 B2 12/2006 Andersen et al.

(Continued)

FOREIGN PATENT DOCUMENTS

NL 9401836 6/1996

*Primary Examiner*—Thomas J Mullen
(74) *Attorney, Agent, or Firm*—Hogan & Hartson, LLP

(57) ABSTRACT

A removable mount for mounting an electronic system component on a forklift includes, in one embodiment, a mounting plate having a major surface for mounting the electronic system component and an inverted J-shaped part located at a top portion of the mounting plate. The inverted J-shaped part is adapted for mounting the mounting plate on an unmodified original equipment manufacture (OEM) carriage of the forklift or an unmodified OEM sideshifter of the forklift. The mounting plate also has a slot to accommodate a fastener for anchoring the mounting plate to the unmodified OEM carriage or to the unmodified OEM sideshifter.

29 Claims, 18 Drawing Sheets

U.S. PATENT DOCUMENTS

| | | | | |
|---|---|---|---|---|
| 7,155,304 | B1 | 12/2006 | Charych | |
| 7,221,269 | B2 | 5/2007 | Onderko et al. | |
| 7,233,241 | B2 | 6/2007 | Overhultz et al. | |
| 7,236,851 | B2 | 6/2007 | Charych | |
| 7,243,476 | B2 | 7/2007 | Schneider | |
| 7,339,541 | B2 | 3/2008 | Schadler | |
| 2002/0130817 | A1 | 9/2002 | Forster et al. | |
| 2004/0102870 | A1* | 5/2004 | Andersen et al. | 340/572.8 |
| 2005/0052281 | A1 | 3/2005 | Bann | |
| 2005/0076816 | A1* | 4/2005 | Nakano | 108/51.11 |
| 2005/0200457 | A1* | 9/2005 | Bridgelall et al. | 340/10.3 |
| 2006/0058913 | A1 | 3/2006 | Andersen et al. | |
| 2006/0132312 | A1 | 6/2006 | Tavormina | |
| 2006/0208893 | A1 | 9/2006 | Anson et al. | |
| 2006/0220872 | A1* | 10/2006 | Brown et al. | 340/572.7 |
| 2006/0287760 | A1* | 12/2006 | Charych | 700/214 |

* cited by examiner

REMOVABLE MOUNT FOR MOUNTING AN ELECTRONIC SYSTEM COMPONENT ON A FORKLIFT

PRIORITY CLAIM

The present application claims priority benefit of U.S. Provisional patent application Ser. No. 60/733,295 filed on Nov. 3, 2005, and incorporates the same herein by reference.

DESCRIPTION OF THE RELATED ART

A forklift typically includes several types of electronic systems that are mounted on various parts of the forklift. Some of these electronic systems are original equipment manufacture (OEM) parts that come pre-assembled on the forklift while others are after-market add-ons that cater to specific needs of a customer. Some examples of after-market add-ons include: communication systems such as a radio transceiver; video systems such as a camera; and inventory tracking systems such as a bar-code scanner or a radio frequency identification (RFID) device. In some cases, the after-market add-ons are permanently mounted on the forklift using welding processes for example, while in other cases the after-market add-ons are temporarily mounted on the forklift using hooks and straps for example. In yet other cases a semi-permanent mounting is carried out whereby the electronic system is securely mounted on the forklift to withstand shock and vibration yet can be dismounted without involving a high level of effort as may be associated with dismounting a permanently mounted device.

Several aspects related to this type of semi-permanent mounting will be described below using an exemplary RFID system. It will be understood that the RFID system is being used merely for purposes of description, and that the mounting system and methods are equally applicable to other electronic systems.

An RFID system typically uses an RFID tag reader to query an RFID tag attached to an object. The RFID tag provides certain information associated with the tagged object. RFID systems are used in diverse applications such as product tracking, vehicle identification for toll-fee collection purposes, theft prevention, and warehouse inventory control. Each of these applications presents a unique set of problems that have to be resolved to ensure efficient operation of the RFID system.

With specific reference to warehouse inventory control, the RFID system has to efficiently operate in a harsh operating environment that is typical of a warehouse. RFID tag readers are installed at various locations in the warehouse. Some of these locations are stationary mounting locations, such as that of a RFID tag reader installed on a post located adjacent to a conveyor belt. Other locations are mobile mounting locations, such as that of an RFID tag reader installed on a forklift. The RFID tag reader mounted on the forklift is typically operated to communicate with RFID tags attached to various objects transported by the forklift as well as stationary objects that may be located on a store shelf.

Mounting the RFID tag reader upon the forklift involves several operational as well as logistical considerations. Consequently, prior to installation of the RFID tag reader, an acceptable mounting location has to be identified such that installation and operation of the RFID tag reader will not interfere with, nor be affected by, the operation of the forklift.

For example, the mounting location has to be selected such that operator visibility will not be adversely affected. This factor precludes mounting the RFID tag reader at various eye-level locations. Additionally, the mounting location has to be selected so that moving parts of the forklift do not damage any components of the RFID tag reader. This factor becomes especially important when the RFID tag reader contains multiple components externally interconnected to one another by wires and cables that may be accidentally cut by moving parts of the forklift. Such damage can be mitigated to some extent by using a RFID tag reader that is a self-contained, independent assembly with no external wires or cables.

Unfortunately, even a RFID tag reader that is a self-contained, independent assembly has to be mounted on a forklift with several additional considerations in mind. One such significant consideration is the cost of mounting the RFID tag reader upon a suitable location of the forklift. The cost of mounting the RFID tag reader may be broken down into several contributory costs, such as installation cost, forklift downtime cost, and forklift modification cost. Obviously, these costs become significant when the installation has to be carried out upon a large number of forklifts.

While installation cost and forklift downtime cost are self-explanatory, the aspect of forklift modification cost requires further elaboration. Forklift modification cost relates to the cost of hardware modification carried out upon the forklift specifically for the purposes of mounting the RFID the reader. Hardware modification cost includes the cost of acquiring mounting fixtures as well as the labor cost associated with installing the mounting fixtures. Labor cost becomes especially significant when the mounting fixture is somewhat long-term in nature, for example, a mounting fixture that is welded on to a frame of the forklift.

An additional factor that plays a role in mounting an RFID tag reader upon a forklift relates to the ease with which the unit can be dismounted from the forklift and re-mounted on a different forklift. When such a transfer is carried out it is desirable that the dismounting process be quick and cost efficient, preferably carried out in a manner that does not leave behind residual mounting hardware on the forklift. Unfortunately, in many cases, the mounting fixture that is welded on to the frame of the forklift is not dismantled when the RFID tag reader is removed.

Based on the shortcomings mentioned above, an unaddressed need exists in the industry to overcome such deficiencies and inadequacies.

SUMMARY

In one exemplary embodiment in accordance with the invention, a removable mount for mounting an electronic system component on a forklift includes a mounting plate having a major surface for mounting the electronic system component and an inverted J-shaped part located at a top portion of the mounting plate. The inverted J-shaped part is adapted for mounting the mounting plate on an unmodified original equipment manufacture (OEM) carriage of the forklift or on an unmodified OEM sideshifter of the forklift. The mounting plate also has a slot to accommodate a fastener for anchoring the mounting plate to the unmodified OEM carriage or to the unmodified OEM sideshifter.

Clearly, some alternative embodiments may exhibit advantages and features in addition to, or in lieu of, those mentioned above. It is intended that all such alternative embodiments be included within the scope of the present invention, and be protected by the accompanying claims.

BRIEF DESCRIPTION OF THE DRAWINGS

Many aspects of the invention can be better understood with reference to the following drawings. The components in the drawings are not necessarily to scale. Instead, emphasis is placed upon clearly illustrating the principles of the invention. Moreover, in the drawings, like reference numerals designate corresponding parts throughout the several views.

DETAILED DESCRIPTION

The various embodiments in accordance with the invention generally describe a removable mount for detachably mounting an electronic system component, such as a radio frequency identification (RFID) system component, upon a forklift. Also described, are various methods for mounting the removable mount on a carriage or a sideshifter of the forklift.

Figure 1:
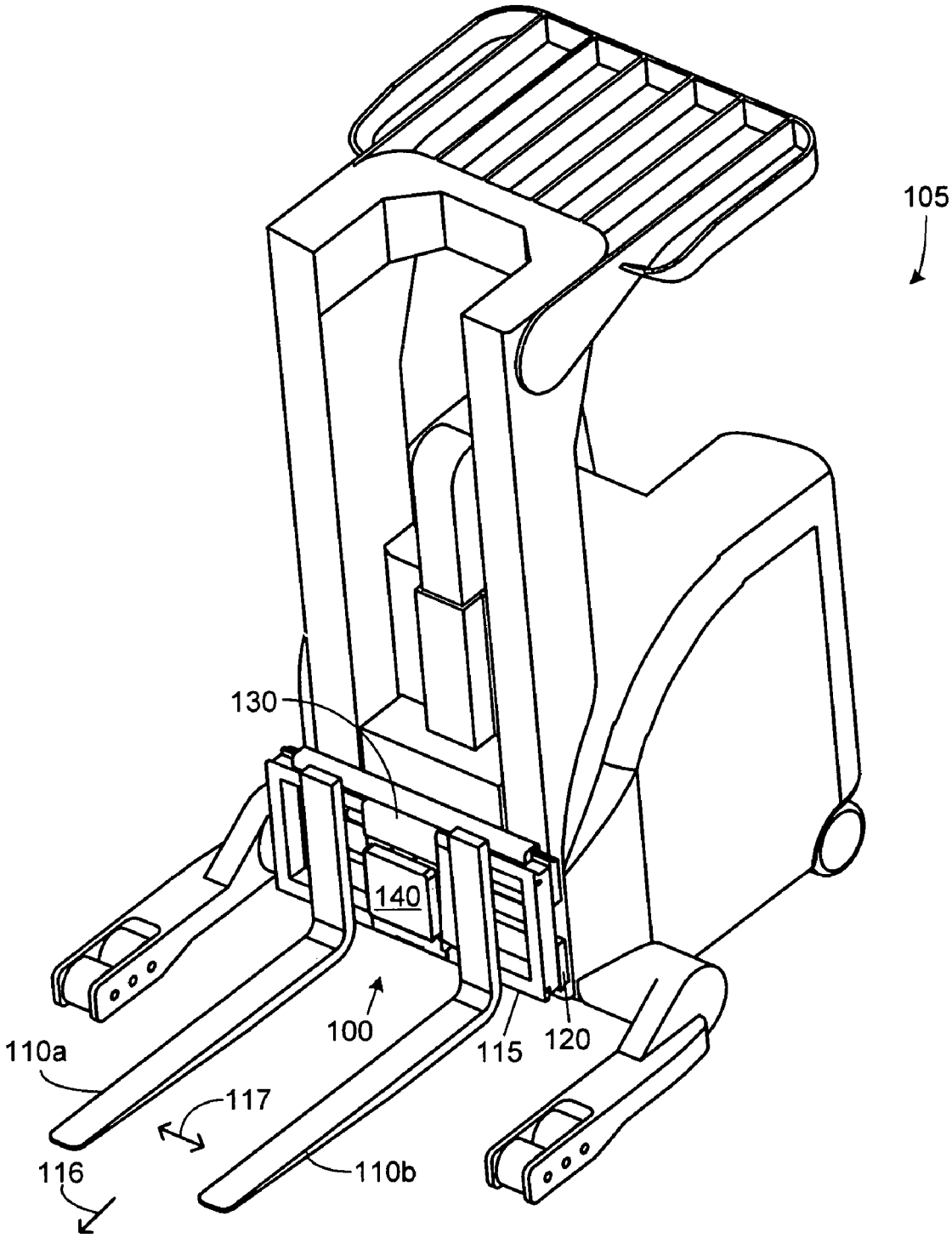
FIG. 1 shows a first exemplary embodiment in accordance with the invention of a removable mount for mounting an electronic system component on a forklift.

FIG. 1 shows a first exemplary embodiment in accordance with the invention of a removable mount 100 mounted on a forklift 105. Forklift 105 is used here merely for purposes of illustration and it will be understood that in various embodiments, the removable mount is mountable on a variety of forklifts. Forklift 105 has a pair of tines 110*a* and 110*b* that are used to lift a load for transporting the load from one location to another. The term "tine" may be alternatively referred to as a "fork." Typically, an operator drives forklift 105 in the direction indicated by arrow 116 and inserts tines 110*a* and 110*b* under the load before raising tines 110*a* and 110*b* for transporting the load. Sometimes during this operation, tines 110*a* and 110*b* may not be located at an appropriate point below the load. Consequently, the operator has to drive back and forth to reposition forklift 105. However, this back and forth driving can be eliminated by using an additional fixture, referred to in the art as a "sideshifter," which provides bilateral movement in the direction indicated by bi-directional arrow 117. The sideshifter allows the operator to reposition tines 110*a* and 110*b* laterally without having to travel back and forth to do so.

An exemplary sideshifter 115 is shown in FIG. 1. Sideshifter 115 is typically mounted on a mounting frame that for purposes of description is referred to herein as a carriage 120. Sideshifter 115 is slideably mounted on an upper horizontal lip of carriage 120 and can be moved sideways, by an operator of forklift 105. The sideways movement is indicated by arrow 117.

Similar to carriage 120, sideshifter 115 also has an upper horizontal lip upon which is installed the pair of tines 110*a* and 110*b*. Each of pair of tines 110*a* and 110*b* has an inverted J-shaped part located on the backside of the vertical part of the tine. Installation is typically carried out by an installer who manually engages the inverted J-shaped part of one of the two tines with the upper horizontal lip at one end thereof of sideshifter 115. The installer then manually moves the tine to a suitable position along the length of the upper horizontal lip. The other tine is then installed from the other end of sideshifter 115 in a similar manner and moved to an appropriate position on the sideshifter such that there is a suitable spacing between the two tines.

Typically, the horizontal upper lip of carriage 120 and the horizontal upper lip of sideshifter 115 resemble one another in dimension and shape. Similarly, there are several other components of carriage 120 and sideshifter 115 that resemble one another in dimension and shape. For example, both carriage 120 and sideshifter 115 contain identical threaded holes at various locations.

Consequently, removable mount 100 may be interchangeably mounted on either sideshifter 115 or on carriage 120. In the exemplary embodiment shown in FIG. 1, removable mount 100 is shown mounted on the front surface of sideshifter 115. It will be understood that the description provided below is equally pertinent to installing removable mount 100 on carriage 120.

Removable mount 100 incorporates various types of mounting hardware, such as a mounting plate 130 and a threaded bolt (not shown) that are used for readily mounting removable mount 100 upon sideshifter 115 and also for dismounting removable mount 100 from sideshifter 115 without leaving behind any residual mounting hardware as may be the case in prior-art solutions. One example of such residual mounting hardware is a metal bracket welded on to a sideshifter, such as sideshifter 115, specifically for the purposes of accommodating a prior-art mount.

Mounting plate 130 has a first major surface upon which is mounted an electronic system component. In this example, the electronic system component is a modular antenna system 140 of an RFID system. An RFID reader module (not shown) is mounted on the major surface on the opposite side of the first major surface. The RFID reader module as well as modular antenna system 140 will be described in more detail using FIGS. 2A and 3 below.

Mounting plate 130 further contains a slot (not shown) configured for accommodating a fastener for anchoring mounting plate 130 to sideshifter 115. In this exemplary embodiment the fastener is a threaded bolt, which is inserted through the slot and mated with a threaded aperture (not shown) located in sideshifter 115.

The threaded aperture can be implemented in several alternative ways. For example, in a first embodiment, the threaded aperture is intentionally made in sideshifter 115 for the purposes of mounting the mounting plate 130. Consequently, this threaded aperture is an aftermarket modification that is carried out by an owner of forklift 105 or a vendor, for example, at a suitable location in sideshifter 115. Anchoring mounting plate 130 in this manner by using the threaded aperture in sideshifter 115 eliminates the need for adding intrusive mounting hardware, such as a welded bracket, a welded bolt, or a welded hook.

The threaded aperture can be left undisturbed in the forklift without any inconvenience when removable mount 100 is dismounted from forklift 105. Consequently, certain dismounting costs, such as those associated with the removal of welded parts, are eliminated.

In a second exemplary embodiment, the threaded aperture is a pre-existing aperture in an original equipment manufacturer (OEM) sideshifter or an OEM carriage. In the context of this disclosure, the term "OEM" refers to a component that has been unmodified since the time the component was originally manufactured. Consequently, the threaded aperture of the second exemplary embodiment is an aperture that is provided by the original manufacturer and not one that is made afterwards by the vendor or owner of the forklift.

Figure 2A:
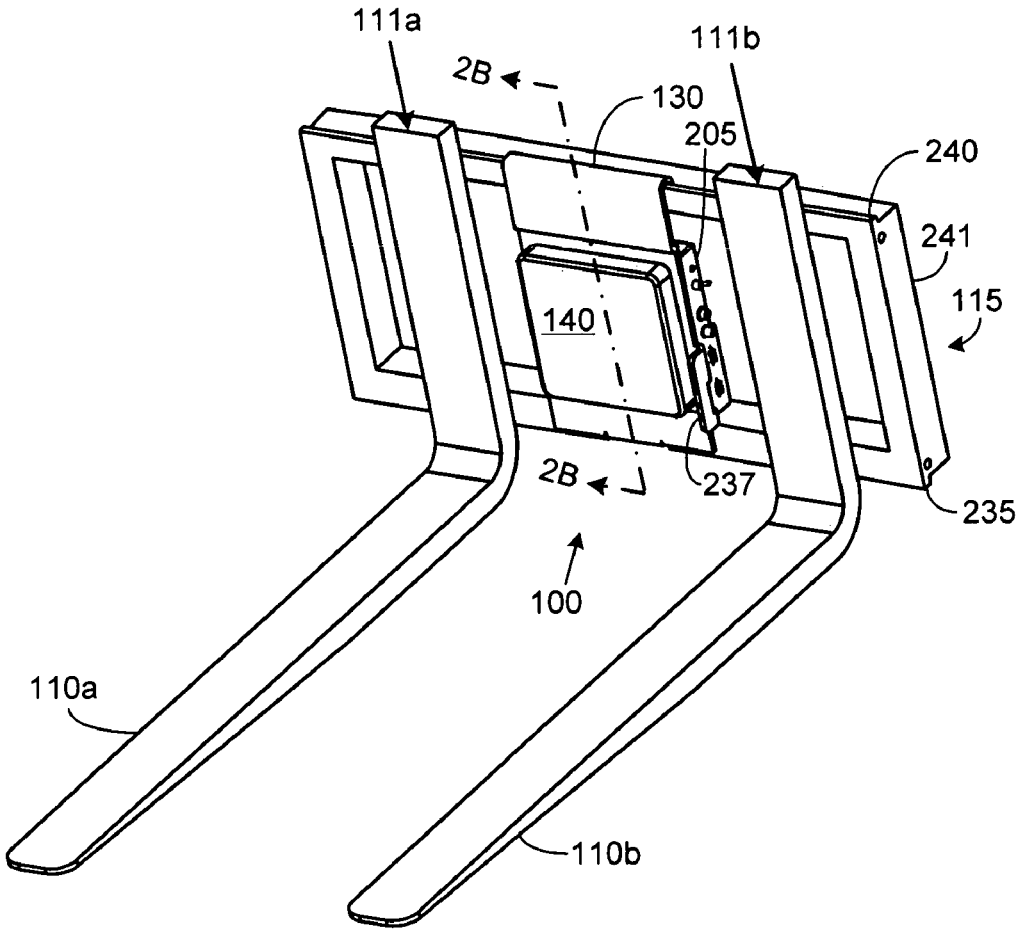
FIG. 2A shows some details of the removable mount of FIG. 1.

FIG. 2A shows removable mount 100 mounted on sideshifter 115. In this exemplary embodiment, removable mount 100 is mounted on a primary frame 241 of sideshifter 115. Primary frame 241 is a rectangular shaped part having an upper horizontal lip 240 and a lower horizontal lip 235. Upper horizontal lip 240 is located on an upper surface of an upper horizontal member and lower horizontal lip 235 is located on a bottom surface of a lower horizontal member of sideshifter 115.

Removable mount 100 houses one or more electronic system components. In this exemplary embodiment, removable mount 100 houses an RFID reader module 205 and a modular antenna system 140 on two opposing faces of mounting plate 130. RFID reader module 205 is used to read one or more RFID tags that are located in one or more objects (not shown) placed on tines 110*a* and 110*b*. RFID reader module 205 optionally detects the presence of such object(s) by using an opto-electronic sensor (not shown) that is typically mounted on a flange, such as flange 237, of mounting plate 130.

Mounting plate 130 is anchored to sideshifter 115 by using an inverted J-shaped part and a flange, both of which will be described further using FIGS. 2B and 2C.

Figure 2B:
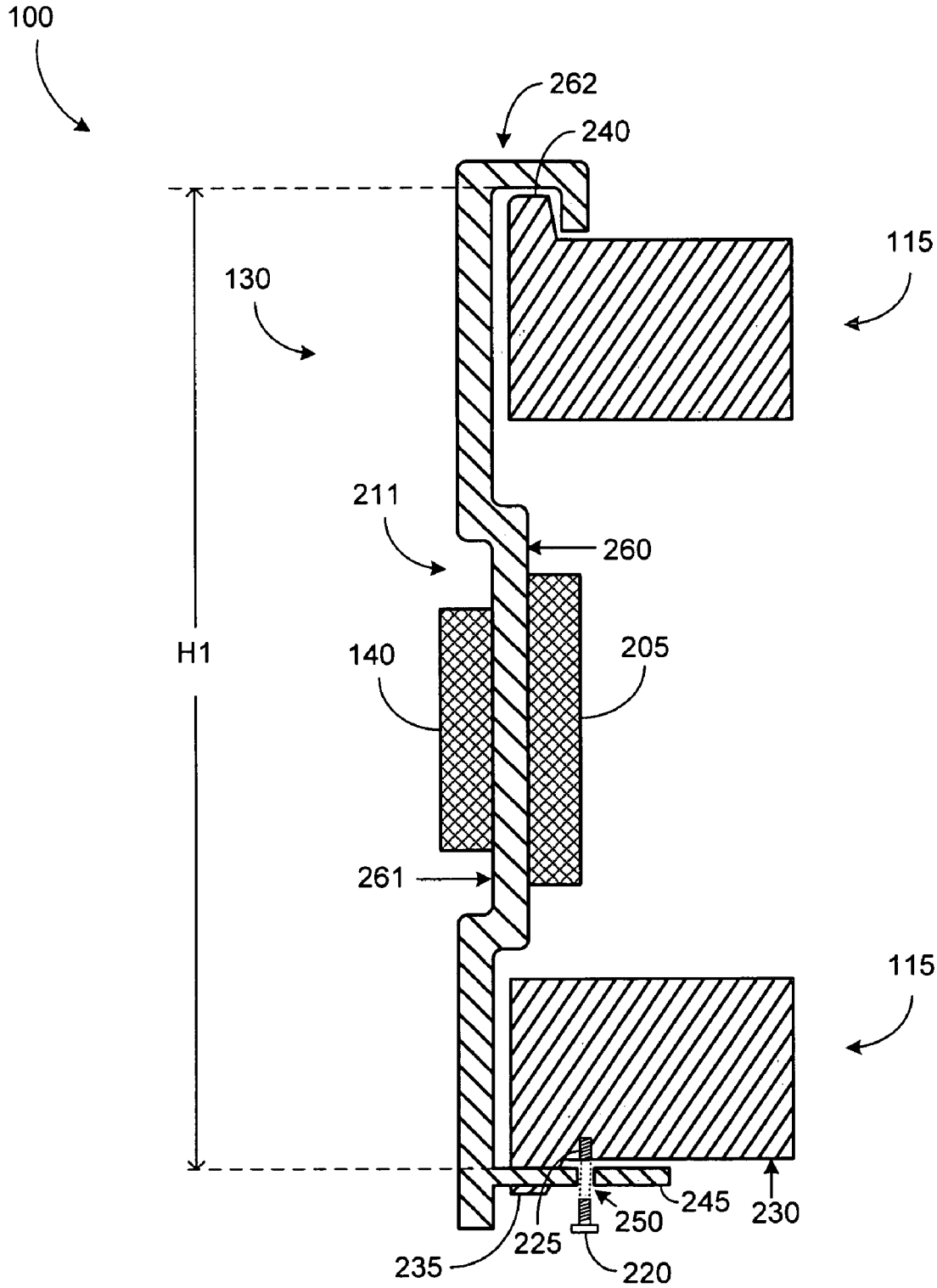
FIG. 2B shows a cross-sectional view of the removable mount of FIG. 2A.

FIG. 2B shows a cross-sectional view of mounting plate 130 and sideshifter 115 along the cross-section axis 2B-2B identified in FIG. 2A. Modular antenna system 140 is attached to mounting surface 261 of mounting plate 130, and RFID reader module 205 is attached on the opposite side to mounting surface 260. In other embodiments, RFID reader module 205 and/or modular antenna system 140 are attached to other surfaces on either side of, and at, different locations on mounting plate 130.

The top portion of mounting plate 130 is formed with an inverted J-shaped part 262 shaped to fit around the shape of upper horizontal lip 240 of sideshifter 115. Shapes other than the inverted J-shape, an inverted semi-circular shape for example, may be used in other embodiments. It will be also understood that the term "inverted" as used in inverted J-shaped part, and other similar labels herein, refers to a vertical inversion whereby a "J" for example, is flipped upside-down. The inverted as well as non-inverted J-shaped parts may have a horizontal or lateral inversion depending on the viewing angle, i.e. left or right of the sideshifter 115.

A portion 211 of the major plane of mounting plate 130 is recessed so as to minimize the projection of modular antenna system 140 beyond a vertical plane defined by the front vertical surfaces 111*a* and 111*b* of tines 110*a* and 110*b* respectively. In other embodiments, mounting plate 130 can be shaped in various alternative forms such as a flat plate or a curved plate, for example.

Mounting plate 130 further comprises a horizontal flange 245 located near the bottom edge of mounting plate 130 and projecting orthogonally outwards with reference to the vertical plane of mounting plate 130. Horizontal flange 245 has a width dimensioned to fit into a notch, which will be further described using FIG. 2C, located in the bottom horizontal member of sideshifter 115. Horizontal flange 245 also has a length dimensioned to cause horizontal flange 245 to protrude beyond a threaded aperture 225 in bottom surface 230 of the bottom horizontal member of sideshifter 115. Horizontal flange 245 further includes a hole, referred to for purposes of description as a slot 250 that is located in general alignment to threaded aperture 225. In one embodiment, slot 250 is a circular hole, while in another embodiment slot 250 is an oval-shaped hole. In yet another embodiment, slot 250 is a threaded hole. It will be understood that for purposes of description the terms "slot," "hole" and "aperture" may be used interchangeably and the nature of these terms are best understood in conjunction with the accompanying figures.

The vertical dimension, H1, of mounting plate 130 measured between an inner surface of the inverted J-shaped part and the upper surface of horizontal flange 245 is approximately equal to the vertical dimension between a top surface of upper horizontal lip 240 and the bottom surface of lower horizontal lip 235.

The process of installing mounting plate 130 upon sideshifter 115 is generally carried out by using the inverted J-shaped part to hang mounting plate 130 from upper horizontal lip 240 of sideshifter 115. This step is followed by aligning horizontal flange 245 with threaded aperture 225, inserting a threaded bolt 220 through slot 250 of horizontal flange 245 and mating threaded bolt 220 with threaded aperture 225. Dismounting mounting plate 130 from sideshifter 115 is generally carried out in reverse order to that of mounting the mounting plate 130 on sideshifter 115.

Figure 2C:
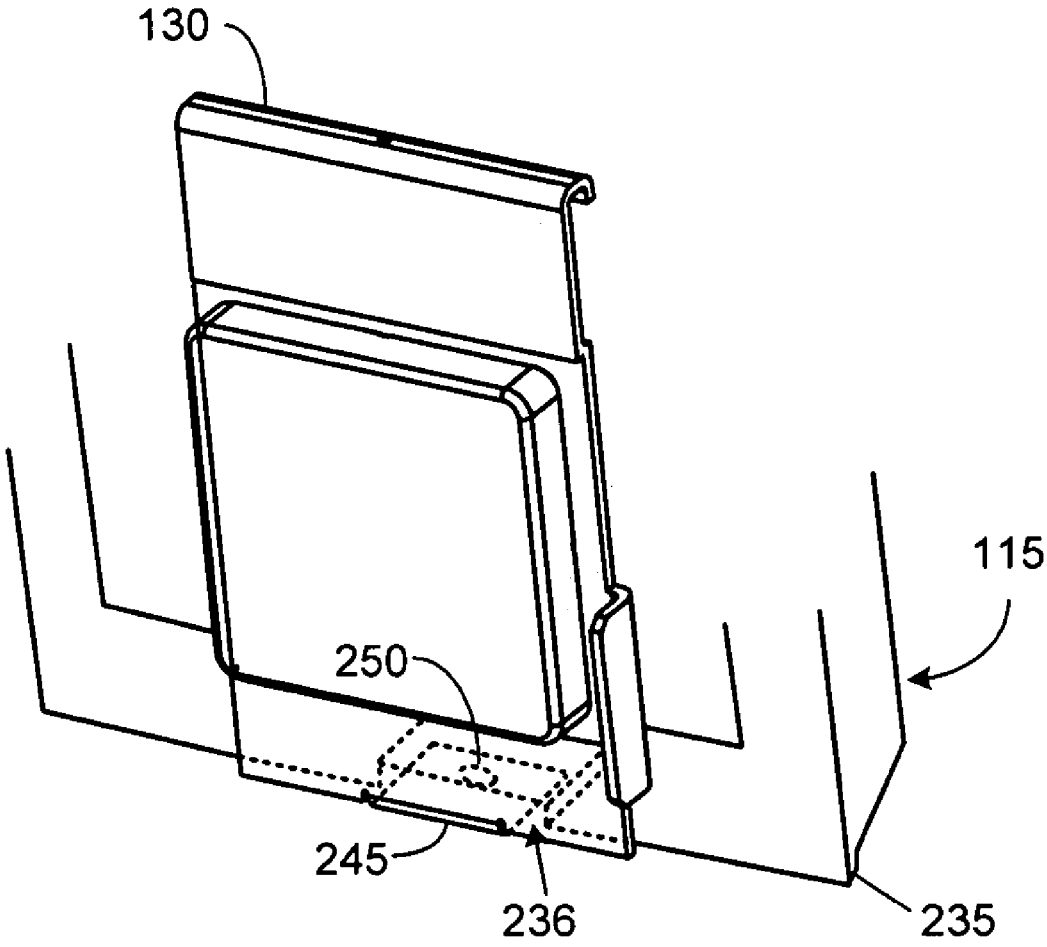
FIG. 2C shows a perspective view to highlight certain aspects of the bottom part of the removable mount of FIG. 2B.

FIG. 2C shows a perspective view to highlight certain aspects of the bottom edge of mounting plate 130. The bottom edge contains a projecting flange 245 that is inserted into notch 236 located in lower horizontal lip 235 of sideshifter 115. Notch 236 is generally an OEM structure that is a part of an OEM carriage or an OEM sideshifter.

Figure 3:
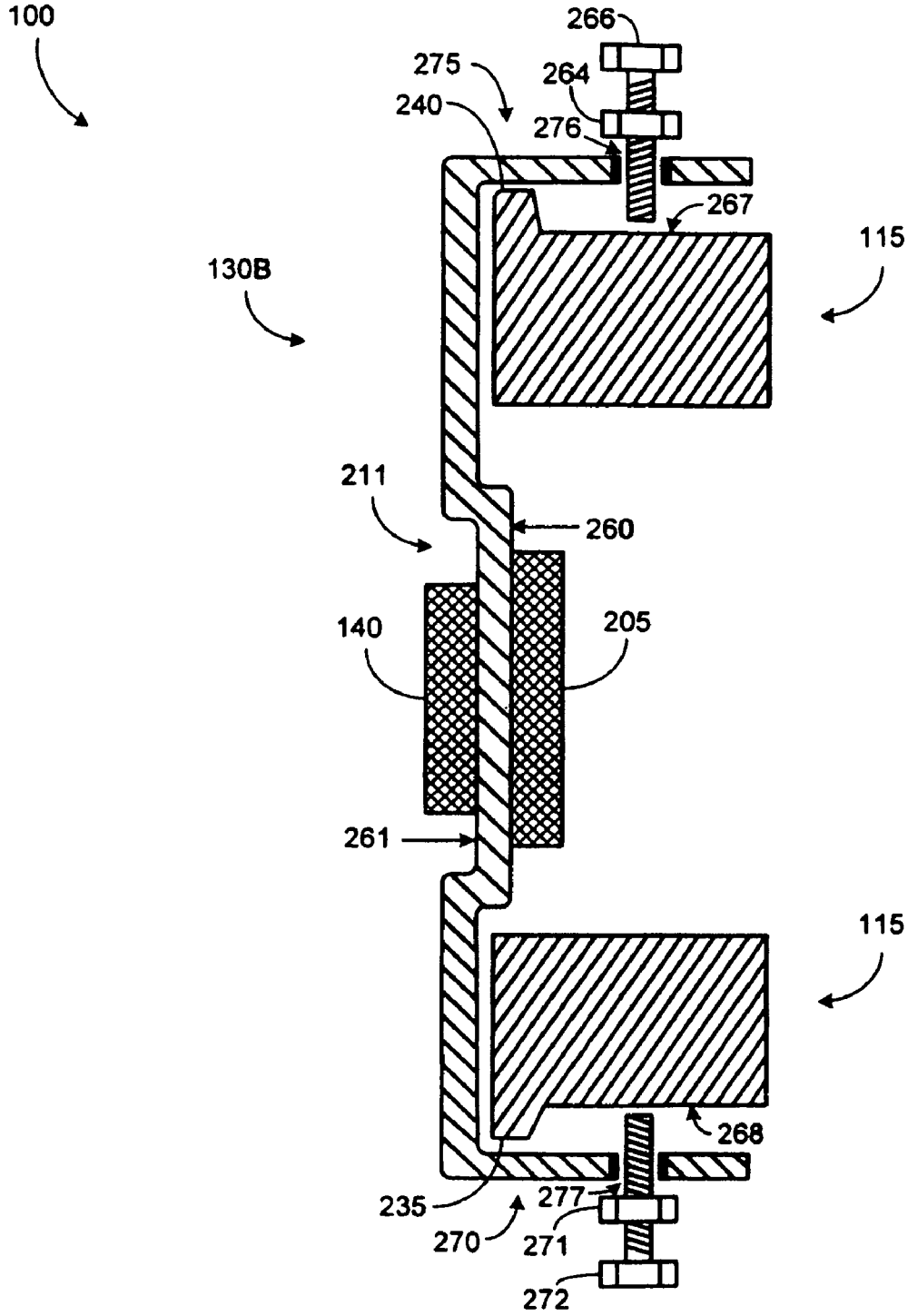
FIG. 3 shows a cross-sectional view of a second exemplary embodiment of a removable mount in accordance with the invention.

FIG. 3 shows a cross-sectional view of a second exemplary embodiment of a removable mount in accordance with the invention. Removable mount 100 includes a single mounting plate 130B that is an alternative embodiment of mounting plate 130 described above with reference to FIG. 2B. Mounting plate 130B and sideshifter 115 are shown along the cross-section axis 2B-2B identified in FIG. 2A.

Here again, modular antenna system 140 is attached to mounting surface 261 of mounting plate 130B, and RFID reader module 205 is attached to an opposing mounting surface 260. In other embodiments, RFID reader module 205 and/or modular antenna system 140 are attached to various other surfaces and locations of mounting plate 130B.

The top portion of mounting plate 130B is formed with an inverted L-shaped part 275 that projects orthogonally away from the vertical plane of mounting plate 130B. Inverted L-shaped part 275 includes a first threaded, mounting hole 276 through which is inserted a first threaded bolt 266. Upon tightening threaded bolt 266, a lower end of threaded bolt 266 impacts upper surface 267 of the upper horizontal member of sideshifter 115 thereby applying pressure on inverted L-shaped part 275 in a vertical direction upwards. Nut 264 is a holding nut that is tightened once threaded bolt 266 is in a desired position. Threaded bolt 266 and nut 264 provide a set-screw functionality to removable mount system 100. This functionality will be described below in further detail.

The bottom portion of mounting plate 130B has an L-shaped part 270 that projects orthogonally away from the vertical plane of mounting plate 130B. L-shaped part 270 includes a second threaded, mounting hole 277 through which is inserted a second threaded bolt 272. Upon tightening threaded bolt 272, an upper end of threaded bolt 272 impacts bottom surface 268 of the lower horizontal member of sideshifter 115 thereby applying pressure on L-shaped part 270 in a vertical direction downwards. Nut 271 is a holding nut that is tightened once threaded bolt 272 has been tightened to a desired extent.

A mounting method for mounting the mounting plate 130B will now be described. Mounting plate 130B is placed against the upper and lower horizontal members of sideshifter 115 with inverted L-shaped part 275 and L-shaped part 270 projecting over upper surface 267 and under bottom surface 268 respectively of sideshifter 115. Threaded bolts 266 and 272 are then operated in tandem to mount removable plate 130B upon sideshifter 115. Tandem operation causes the two ends of mounting plate 130B to move in opposing directions thereby securing mounting plate 130B on sideshifter 115. Once the two threaded bolts have been tightened optimally, the two locking nuts 264 and 271 are tightened to retain the threaded bolts in their tightened positions. It will be understood that the embodiment shown in FIG. 7 does not necessitate an aperture, OEM or otherwise, in sideshifter 115 because threaded bolts 266 and 272 operate as set screws that friction-tighten on upper surface 267 and bottom surface 268 of sideshifter 115.

Figure 4A:
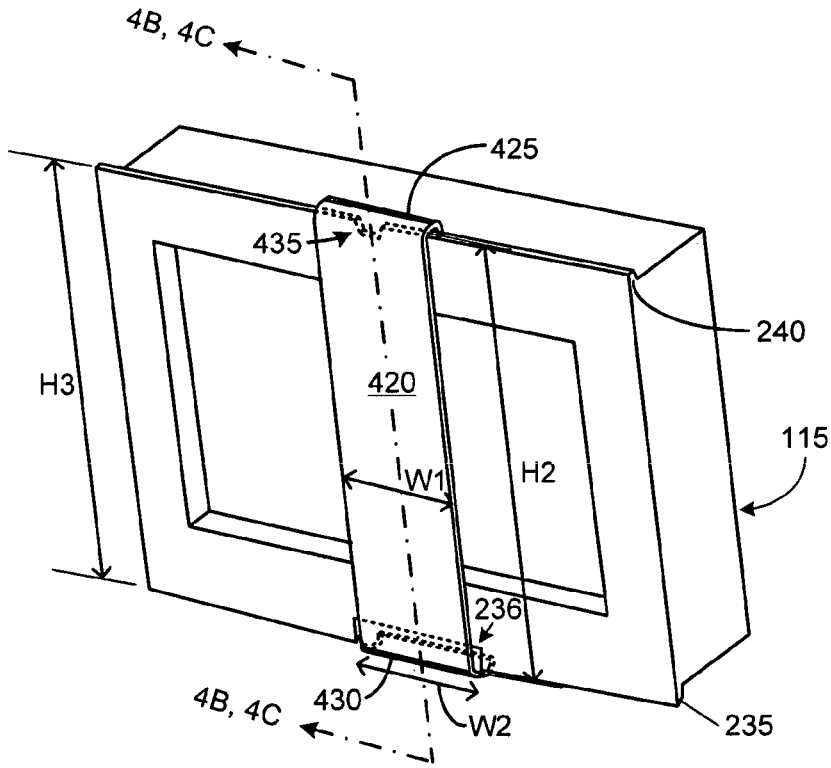
FIGS. 4A-4E show structural features as well as a method of mounting a third exemplary embodiment of a removable mount in accordance with the invention.

FIG. 4A shows a first perspective view of a third alternative embodiment of a removable mount in accordance with the invention. The removable mount includes a single mounting plate 420 having an inverted J-shaped part 425 on the top section of the plate. Inverted J-shaped part 425 is shaped to be detachably mounted on upper horizontal lip 240 of sideshifter 115. Single mounting plate 420 further has a J-shaped part 430 on the bottom section of the plate. J-shaped part 430 is shaped to be removably attached to lower horizontal lip 235 of sideshifter 115. Width W1 of single mounting plate 420 is selected to be less than width W2 of notch 236 in lower horizontal lip 235 of sideshifter 115. However, width W1 is selected to be wider than the width of an OEM notch 435 that is present upon upper horizontal lip 240 of sideshifter 115.

Height H2 of single mounting plate 420 measured from the inside surface of inverted J-shaped part 425 to the inside surface of J-shaped part 430, is selected to be slightly greater than the height H3 of the front face of sideshifter 115. The height H3 of the front face of sideshifter 115 is measured from the top surface of upper horizontal lip 240 to the bottom surface of lower horizontal lip 235. The difference (H2-H3) is selected to provide a snug fit for detachably mounting single mounting plate 420 upon sideshifter 115 without excessive play in the vertical direction when single mounting plate 420 is mounted as described below with reference to FIGS. 4B-4E.

Figure 4B:
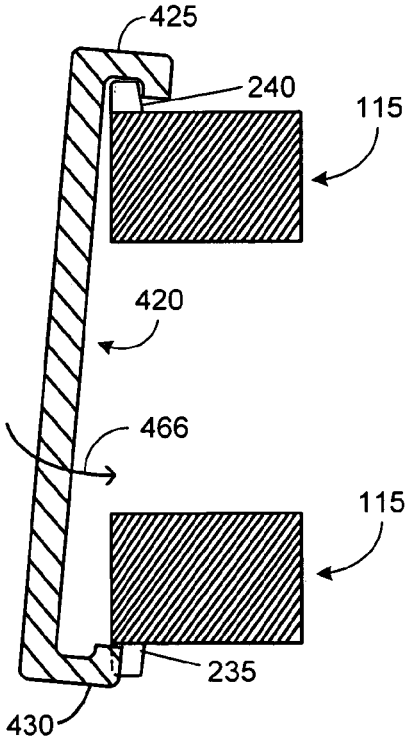
Figure 4C:
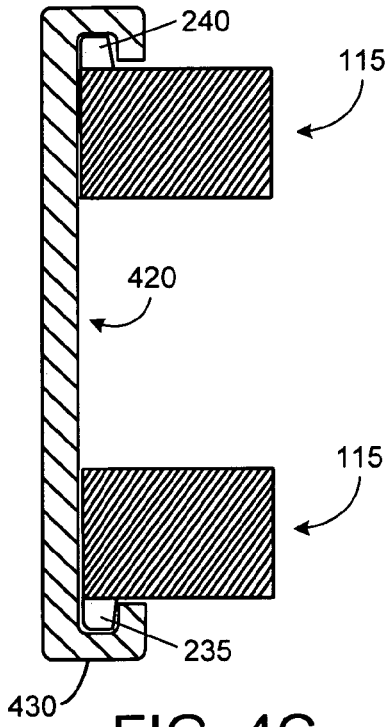

A method of mounting single mounting plate 420 will be described now. FIGS. 4B and 4C are cross-sectional views along the (4B, 4C-4B, 4C) axis shown in FIG. 4A. The (4B, 4C-4B, 4C) axis is a vertical axis located in the horizontal center of notch 236 as well as OEM notch 435.

Inverted J-shaped part 425 is positioned just above, and resting on upper horizontal lip 240 with mounting plate 420 held at an angle such that J-shaped part 430 is aligned with notch 236. Single mounting plate 420 is then swung in a direction indicated by arrow 466 such that J-shaped part 430 is inserted into notch 236 of lower horizontal lip 235. FIG. 4C shows single mounting plate 420 with J-shaped part 430 inserted into notch 236 and the major surfaces of single mounting plate 420 parallel to the vertical surfaces of sideshifter 115. In this position, single mounting plate 420 is supported by upper horizontal lip 240 with J-shaped part 430 free-standing inside notch 236.

Figure 4D:
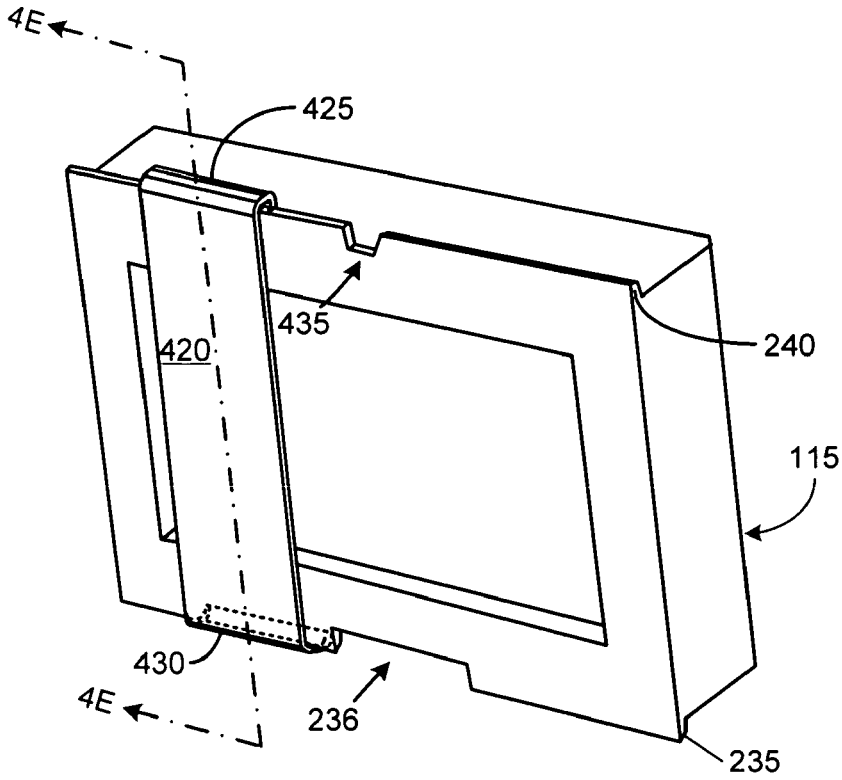
Figure 4E:
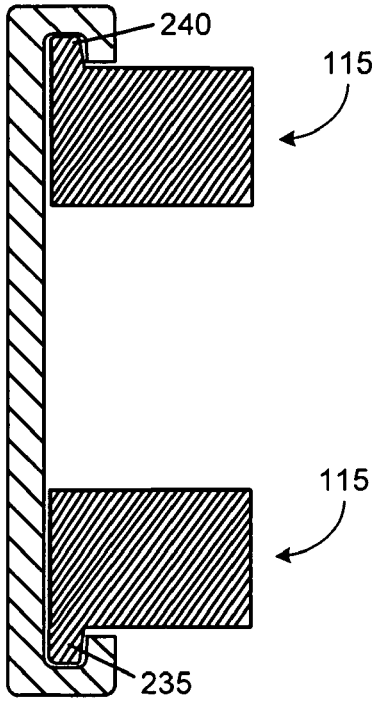

After having been positioned as shown in FIG. 4C, single mounting plate 420 is then slid sideways away from notch 236, whereby J-shaped part 430 engages the bottom surface of lower horizontal lip 235 as illustrated in FIG. 4D and the corresponding cross-sectional view (4E-4E) shown in FIG. 4E.

It will be understood that the mounting of single mounting plate 420 upon sideshifter 115 can be carried out without having to dismount the pair of tines (not shown) that are usually present on sideshifter 115. This method of mounting single mounting plate 420 upon sideshifter 115 provides a number of advantages such as, ease of assembly, reduced training cost, and reduced mounting cost due in part to the absence of specific mounting hardware. The absence of specific mounting hardware allows single mounting plate 420 to be mounted on a forklift having an OEM sideshifter or an OEM carriage without excessive cost or effort.

Figure 4F:
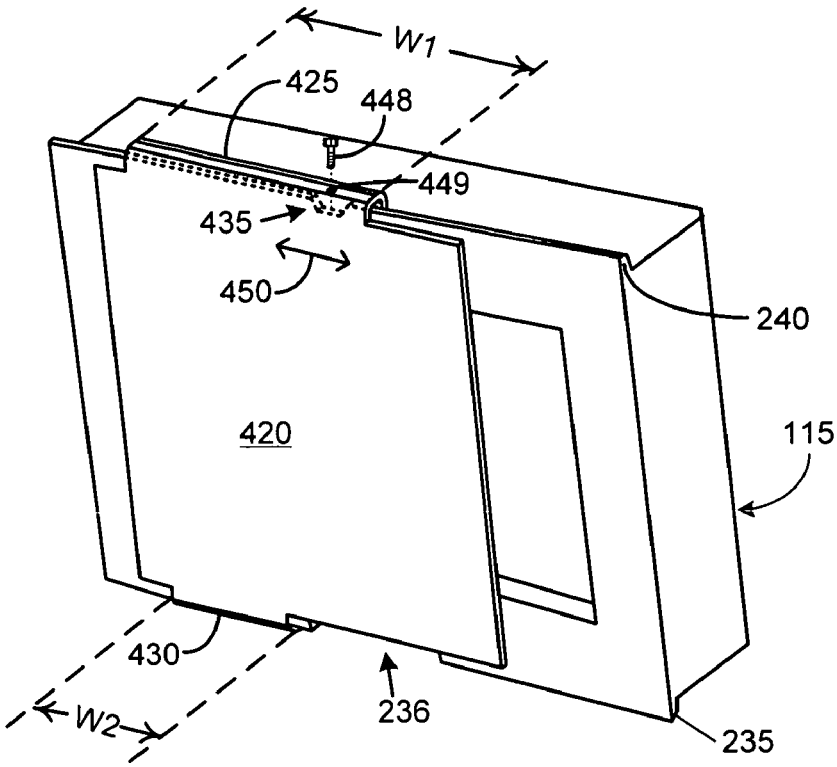
FIG. 4F shows a fourth exemplary embodiment of a removable mount in accordance with the invention.

FIG. 4F shows a fourth exemplary embodiment of a removable mount in accordance with the invention. This embodiment incorporates a single mounting plate 420 having an inverted J-shaped part 425 on the top and J-shaped part 430 on the bottom. An electronic system component, such as an RFID component, may be mounted on either surface of mounting plate 420. The width W1 of inverted J-shaped part 425 exceeds the width W2 of J-shaped part 430. Widths W1 and W2 are selected such that when J-shaped part 430 is positioned away from notch 236, and consequently engaged with the bottom horizontal lip 235, inverted J-shaped part 425 covers notch 435 located on the upper horizontal lip 240. A set-screw 448 is inserted through a hole 449 located in inverted J-shaped part 425 and friction-tightened against the top surface of upper horizontal lip 240 inside notch 435. The set-screw operation prevents lateral displacement of single mounting plate 420 along the bi-directional, horizontal arrow 450 and thereby provides anchoring of single mounting plate 420 upon sideshifter 115 with minimal movement along horizontal as well as vertical directions.

Figure 4G:
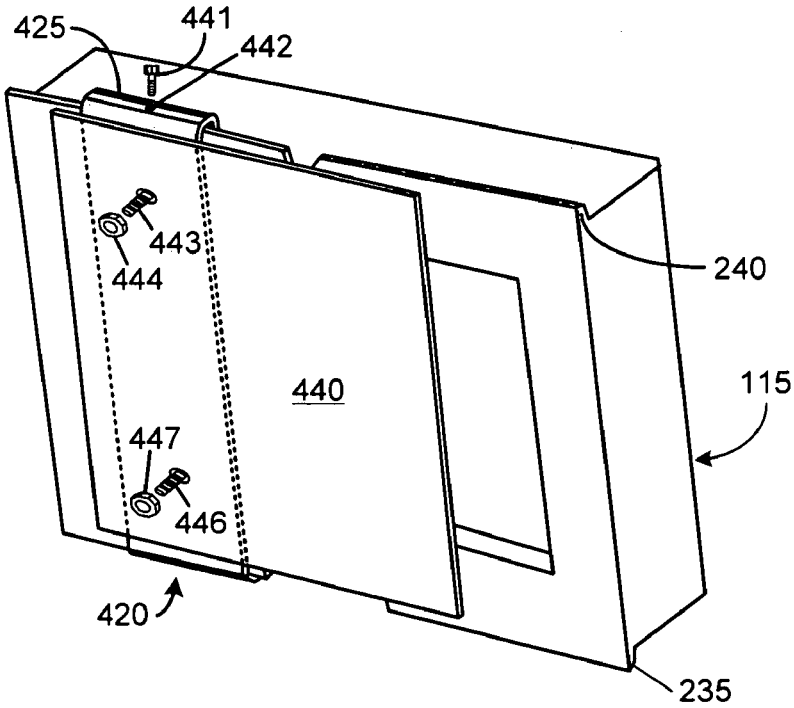
FIG. 4G shows a fifth exemplary embodiment of a removable mount in accordance with the invention.

FIG. 4G shows a fifth exemplary embodiment of a removable mount in accordance with the invention. In this implementation, the removable mount includes mounting plate 420 for removable mounting on sideshifter 115. A second mounting plate 440 on which is mounted an electronic system component (not shown) is detachably attached to mounting plate 420. As described above, mounting plate 420 has inverted J-shaped part 425 on top and J-shaped part 430 on the bottom. In this embodiment, mounting plate 420 further includes one or more threaded bolts that project orthogonally with reference to the major plane of mounting plate 420. Two such bolts, threaded bolts 443 and 446 are shown for purposes of description.

A method of mounting will now be described. Single mounting plate 420 is first installed upon sideshifter 115 by employing the method described above with reference to FIGS. 4A-4E. A set-screw 441 may be optionally used to anchor single mounting plate 420 upon sideshifter 115 as shown in FIG. 4G. This is carried out by tightening set screw 441, which is mated with a threaded hole 442 that is provided on the upper horizontal surface of sideshifter 115.

Secondary plate 440 containing the electronic system component (not shown) is then placed upon single mounting plate 420 such that holes in secondary plate 440 are aligned with threaded bolts 443 and 446. Locknuts 444 and 447 are then employed to semi-permanently attach secondary plate 440 upon single mounting plate 420. The implementation of FIG. 4G permits easy dismounting of secondary plate 440 thereby allowing repair and/or replacement of the electronic system component.

Figure 5:
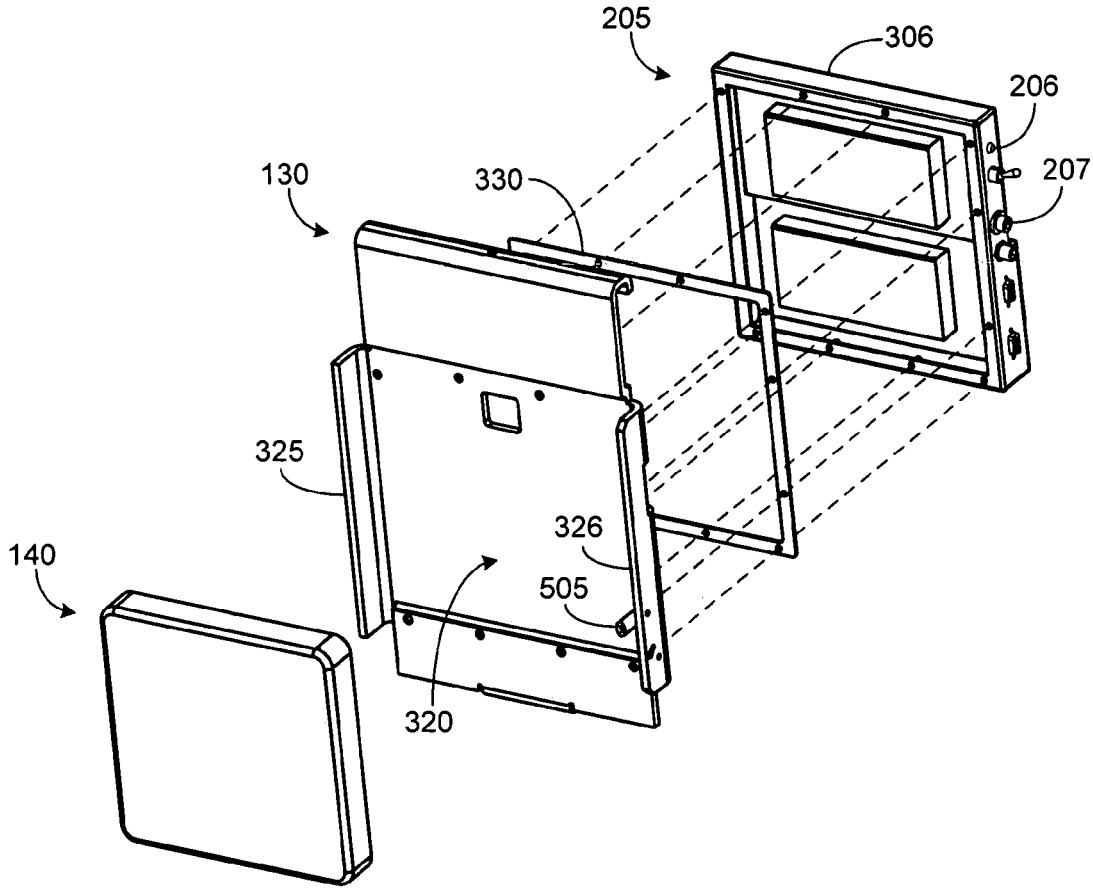
FIG. 5 shows an exploded view of the removable mount of FIG. 2C together with assembly details for mounting exemplary RFID system components upon the removable mount.

FIG. 5 shows an exploded view of mounting plate 130 together with assembly details for mounting electronic system components, which is, in this case, exemplary RFID system components, upon mounting plate 130. The exemplary RFID system components that are shown in FIG. 5 include: modular antenna system 140, gasket 330, and RFID reader module 205.

RFID reader module 205 contains electronic circuitry associated with reading RFID tags. The electronic circuitry is typically assembled on a printed circuit board (PCB), which is assembled upon a back-plate (not shown) that is part of a mounting frame 306 of RFID reader module 205. In this exemplary embodiment, RFID reader module 205 does not include a front-plate.

RFID reader module 205 is generally attached to mounting plate 130 by using gasket 330, which provides various mechanical as well as electronic advantages. When attached in this manner, mounting plate 130 operates as a lid of RFID reader module 205. Mounting plate 130 may be further used as a lid for modular antenna system 140 that is mounted on surface 320 of mounting plate 130.

Consequently, mounting plate 130 is optionally operative as a lid to RFID reader module 205, modular antenna system 140, and any other module that may be optionally attached to either major surface of mounting plate 130. One or more gaskets may be optionally provided or omitted when mounting plate 130 is operative as a lid.

Mounting plate 130 includes a vertical flange 325 that is configured to block an object from impacting the modular antenna system 140 or other parts mounted on mounting plate 130. Vertical flange 326 serves a similar purpose. Additionally, one or both vertical flanges 325 or 326 may be used for mounting an opto-electronic sensor 505 to sense the presence of an object placed upon the tines of the forklift.

Figure 6:
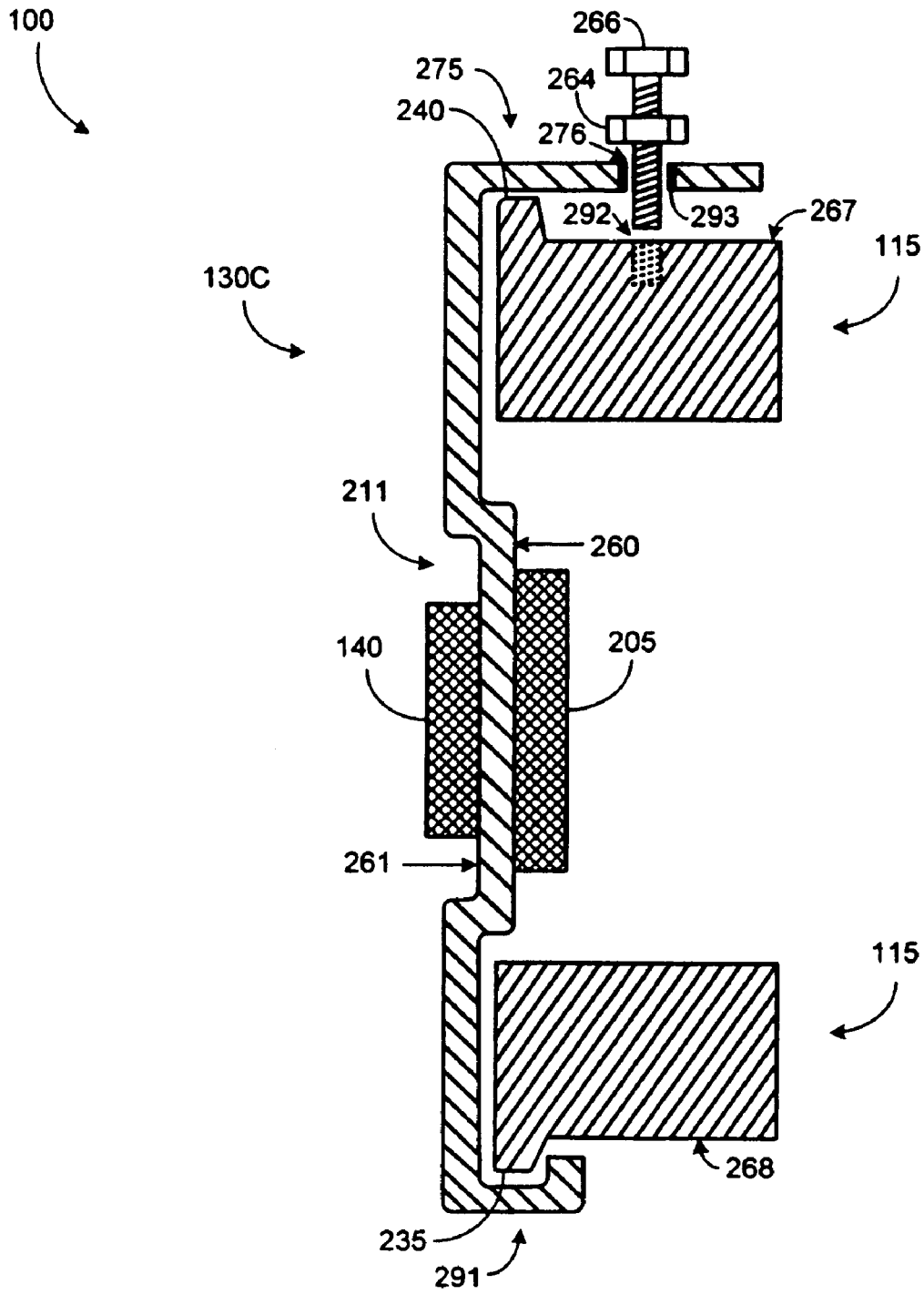
FIG. 6 shows a cross-sectional view of a sixth exemplary embodiment of a removable mount in accordance with the invention.

FIG. 6 shows a cross-sectional view of a sixth alternative embodiment of a removable mount in accordance with the invention. In this embodiment, removable mount 100 includes a mounting plate 130C that is an alternative implementation of mounting plate 130B described above with reference to FIG. 3. The top portion of mounting plate 130C is formed of an inverted L-shaped part 275 as was described above using FIG. 3. L-shaped part 275 projects orthogonally away from the vertical plane of mounting plate 130C. Inverted L-shaped part 275 includes a first mounting hole 276 through which is inserted a first threaded bolt 266. Upon tightening threaded bolt 266, a lower end of threaded bolt 266 impacts upper surface 267 of the upper horizontal member of sideshifter 115 thereby applying pressure on inverted L-shaped part 275 in a vertical direction upwards. Nut 264 is a holding nut that is tightened once threaded bolt 266 is in a desired position. Threaded bolt 266 and nut 264 provide a set-screw functionality to removable mount system 100.

In an alternative implementation, upper surface 267 contains a threaded hole 292, shown as a dotted outline. Threaded bolt 266 is inserted into the threaded hole 292 to anchor L-shaped part 275 upon sideshifter 115. In yet another implementation, first mounting hole 276 has mating threads 293, which provide mateable contact with threaded bolt 266 when threaded bolt 266 is inserted through mounting hole 276. It will be understood that one or more of the features described above, such as the threaded hole 292 extending inwards from surface 267, mounting hole 276, and nut 264 may be used individually or in one or more combinations in various implementations.

The bottom portion of mounting plate 130C is formed of a J-shaped part 291 that engages lower horizontal lip 235. Upon tightening threaded bolt 266 through threads 293 of mounting hole 276, a lower end of threaded bolt 266 impacts upper surface 267 of the upper horizontal member of sideshifter 115 thereby applying pressure on inverted L-shaped part 275 in a vertical direction upwards. This action causes J-shaped part 291 to also move upwards thereby engaging tighter with lower horizontal lip 235.

Figure 7:
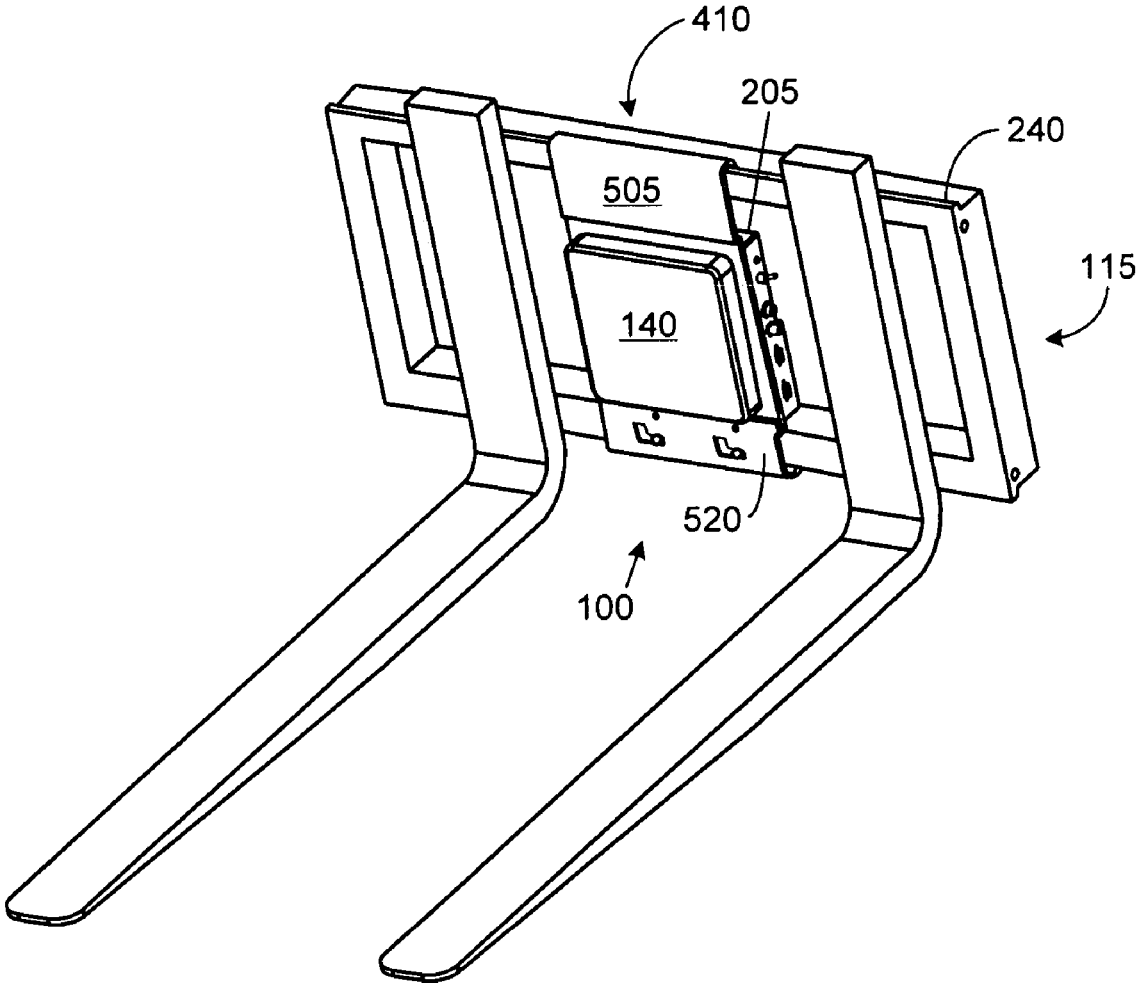
FIG. 7 shows a perspective view of a sideshifter with a seventh exemplary embodiment of a removable mount mounted thereon.

FIG. 7 shows a perspective view of sideshifter 115 with a seventh exemplary embodiment of a removable mount mounted thereon. In this embodiment, removable mount 100 incorporates a two-plate removable mount 410 for mounting an electronic system component on sideshifter 115. First mounting plate 505 contains an inverted J-shaped part that is used to hang mounting plate 505 from upper horizontal lip 240 of sideshifter 115. Electronic system components such as RFID reader module 205 and modular antenna system 140 are mounted on opposing major faces of first mounting plate 505.

Second mounting plate 520 has a J-shaped bottom part that is mated to the bottom horizontal member of sideshifter 115 after first mounting plate 505 is mounted upon the upper horizontal lip 240 of sideshifter 115. Second mounting plate 520 has one or more elongate slots, each elongate slot being dimensioned to accommodate a threaded bolt (not shown) mateable to threaded aperture 225 (not shown) located in the bottom horizontal member of sideshifter 115. The elongate slot, which is L-shaped in one instance, allows second mounting plate 520 to be moved horizontal and/or vertically after the threaded bolt is inserted through the elongate slot. After using the threaded bolt for securing second mounting plate 520 to the bottom horizontal member of sideshifter 115, second mounting plate 520 is attached to first mounting plate 505. Further details of first and second mounting plates are provided below.

Figure 8A:
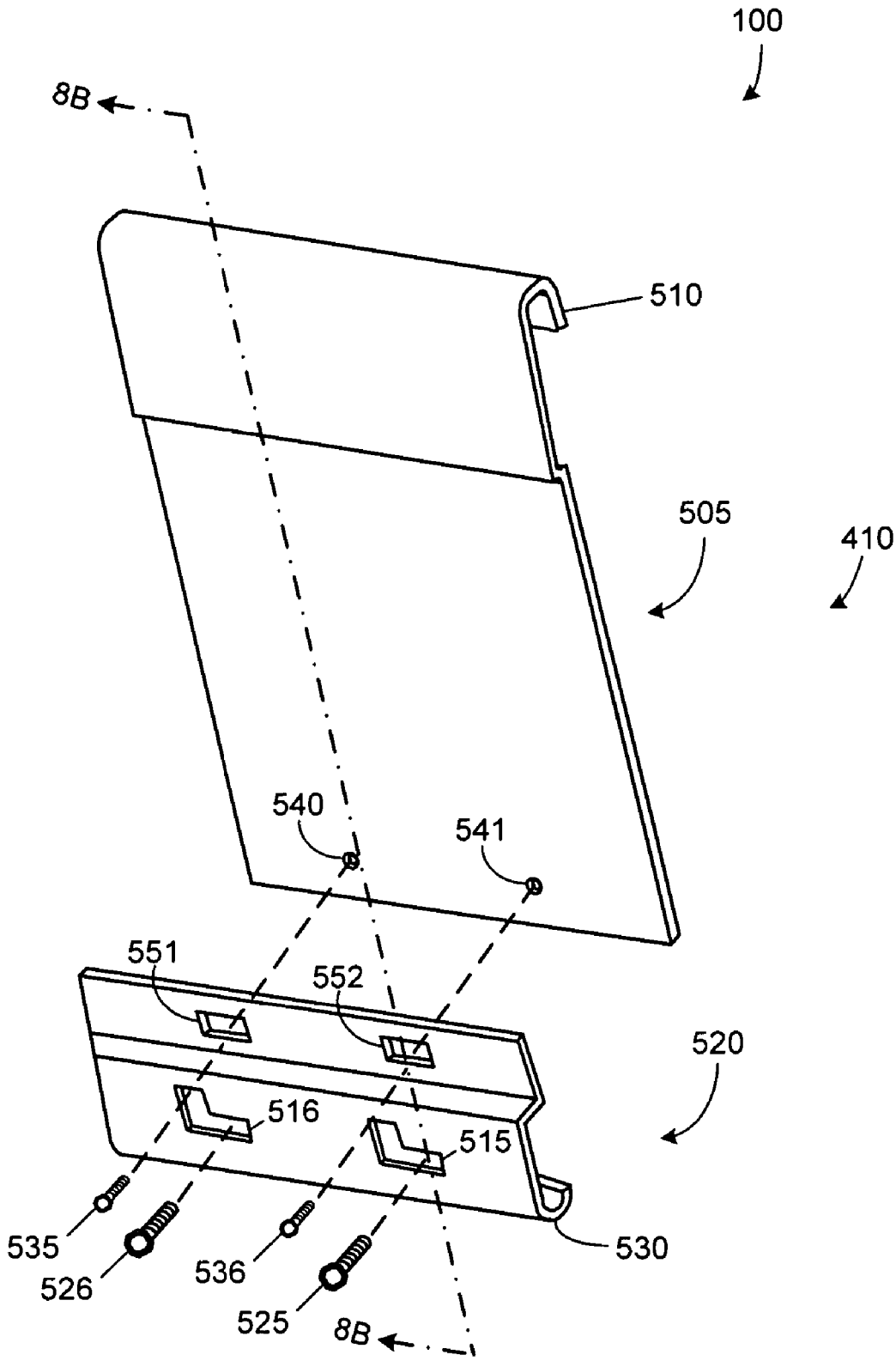
FIG. 8A shows an exploded view of the removable mount of FIG. 7.

FIG. 8A shows an exploded view of a few exemplary parts of two-plate removable mount 410. First mounting plate 505 contains an inverted J-shaped part 510 that is used to hang mounting plate 505 from the upper horizontal lip of sideshifter 115 (not shown).

Second mounting plate 520 includes J-shaped part 530 that is used to mate mounting plate 520 to the lower horizontal lip of sideshifter 115 (not shown).

Second mounting plate 520 also includes a pair of elongate slots 515 and 516 that are each sized to accommodate a pair of threaded bolts 525 and 526 respectively. Each of the pair of threaded bolts 525 and 526 are mated to corresponding threaded apertures (not shown) located in the bottom horizontal member of sideshifter 115. The threaded apertures are OEM apertures in a first case, and a post-OEM modification in a second case. Elongate slots 515 and 516 are L-shaped slots that allow a certain degree of play both in the horizontal and the vertical direction when attaching second mounting plate 520 to the bottom horizontal member of sideshifter 115. When threaded bolts 525 and 526 are located along the horizontal section of the L-shaped slots, undesirable vertical displacement of second mounting plate 520 is prevented.

Second mounting plate 520 further includes a pair of elongate holes 551 and 552 that are each sized to accommodate a second pair of threaded bolts 535 and 536 respectively. Each of the pair of threaded bolts 535 and 536 are mated to corresponding threaded apertures 540 and 541 located in the bottom part of first mounting plate 505.

It will be understood that the number of slots, holes, and threaded apertures described above are merely for purposes of description. In various other embodiments, fewer or larger number of slots, holes, and threaded apertures may be used. Furthermore, slots, holes, and threaded apertures may be present in the first mounting plate 505.

Figure 8B:
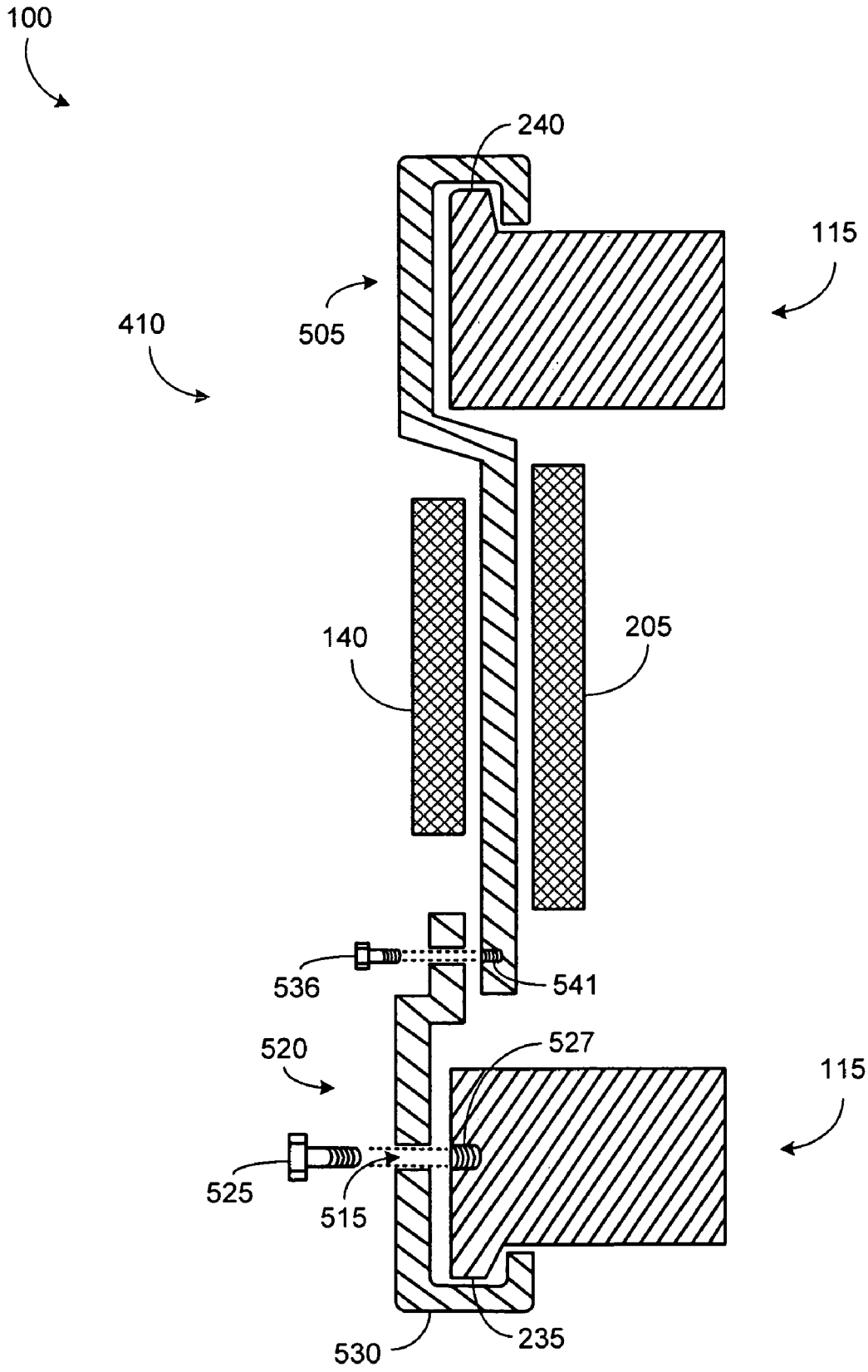
FIG. 8B shows a cross-sectional view of the removable mount of FIG. 7.

FIG. 8B shows a cross-sectional view of the few exemplary components of FIG. 8A together with a cross-sectional view of sideshifter 115. Also shown in this exemplary embodiment are RFID reader module 205 and modular antenna system 140 that are attached to opposing major surfaces of first mounting plate 505. In other embodiments, RFID reader module 205, modular antenna system 140, and other parts may be mounted on either or both major surfaces of first mounting plate 505.

In a typical mounting procedure, first mounting plate 505 is hung on the upper horizontal lip 240 of sideshifter 115. J-shaped part 530 of second mounting plate 520 is then mated to lower horizontal lip 235 of sideshifter 115. Second mounting plate 520 is anchored to bottom horizontal member of sideshifter 115 by mating threaded bolt 525 with threaded aperture 527 on bottom horizontal member of sideshifter 115. Second mounting plate 520 is further anchored to first mounting plate 505 by mating threaded bolt 536 with threaded aperture 541 on first mounting plate 505.

Figure 9A:
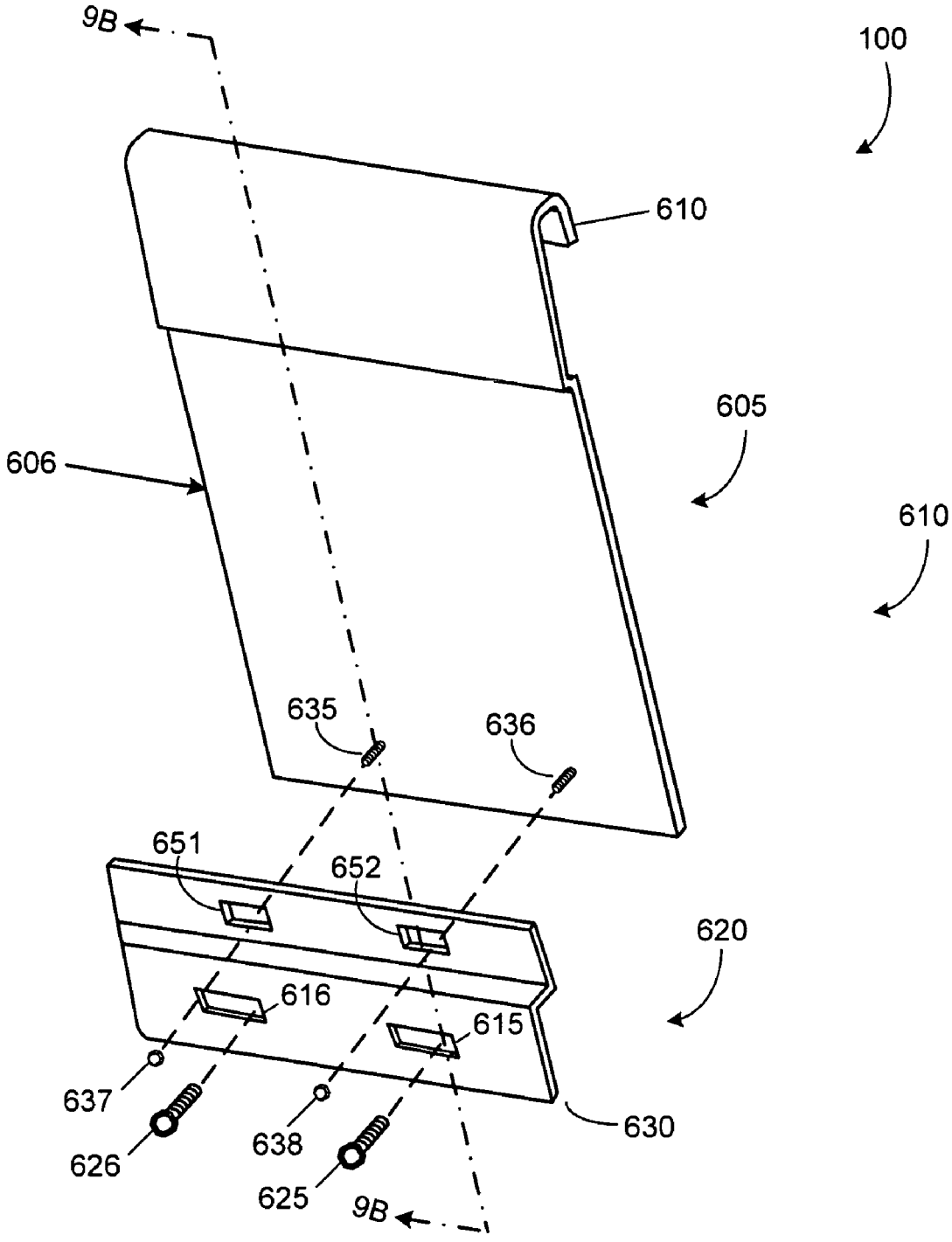
FIG. 9A shows an alternative implementation of the removable mount of FIG. 7.

FIG. 9A shows a perspective view of a few exemplary components of a second embodiment of a two-plate removable mount 610. First mounting plate 605 contains an inverted J-shaped part 610 that is used to hang mounting plate 605 from the upper horizontal lip of sideshifter 115 (not shown).

Second mounting plate 620 includes a pair of elongate slots 615 and 616 that are each sized to accommodate a pair of threaded bolts 625 and 626 respectively. Each of the pair of threaded bolts 625 and 626 are mated to corresponding OEM threaded apertures (not shown) located in the bottom horizontal member of sideshifter 115. Elongate slots 615 and 616 are horizontal slots that allow a certain degree of play in the horizontal direction when attaching second mounting plate 620 to the bottom horizontal member of sideshifter 115. When threaded bolts 625 and 626 are inserted in corresponding threaded apertures and positioned through the horizontal slots, undesirable vertical displacement of second mounting plate 620 is prevented.

Second mounting plate 620 further includes a pair of elongate holes 651 and 652 that are each sized to accommodate a second pair of threaded bolts 635 and 636 respectively. Threaded bolts 635 and 636 project orthogonally from a major surface 606 of first mounting plate 605. Each of the pair of threaded bolts 635 and 636 are mated to corresponding threaded locknuts 637 and 638 that are provided for carrying out the mating.

It will be understood that the number of slots, holes, and threaded apertures described above are merely for purposes of description. In various other embodiments, fewer or larger number of slots, holes, and threaded apertures may be used. Other attachment means such as a latch, a collar, a strap, and a clamp may be used to attach first mounting plate 605 to second mounting plate 620. Such attachment means may be further employed to mount mounting plate 130, described in other embodiments above using FIGS. 2B, 2C, and 5.

Figure 9B:
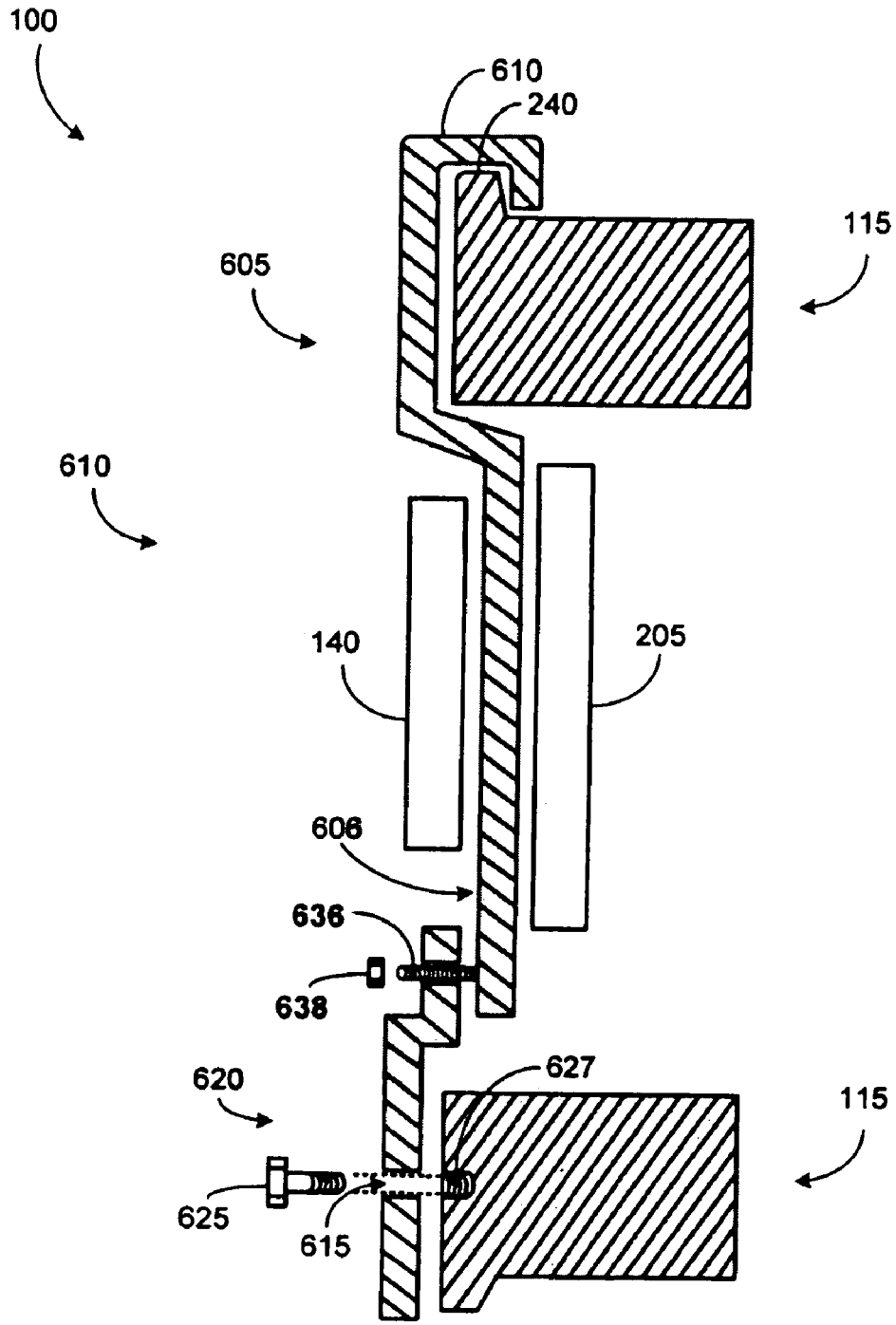
FIG. 9B shows a cross-sectional view of the removable mount of FIG. 9A.

FIG. 9B shows a cross-sectional view of the few exemplary components of FIG. 9A together with a cross-sectional view of sideshifter 115. In this exemplary embodiment, RFID reader module 205 and modular antenna system 140 are attached to opposing major surfaces of first mounting plate 605. In other embodiments, RFID reader module 205, modular antenna system 140, and other parts may be mounted on either or both major surfaces of first mounting plate 605.

In a typical mounting procedure, first mounting plate 605 is hung on the upper horizontal lip 240 of sideshifter 115 using inverted J-shaped part 610. Second mounting plate 620 is anchored to first mounting plate 605 by mating threaded bolt 636 with threaded locknut 638. Second mounting plate 620 is then anchored to bottom horizontal member of sideshifter 115 by mating threaded bolt 625 with threaded aperture 627 on bottom horizontal member of sideshifter 115.

Figure 9C:
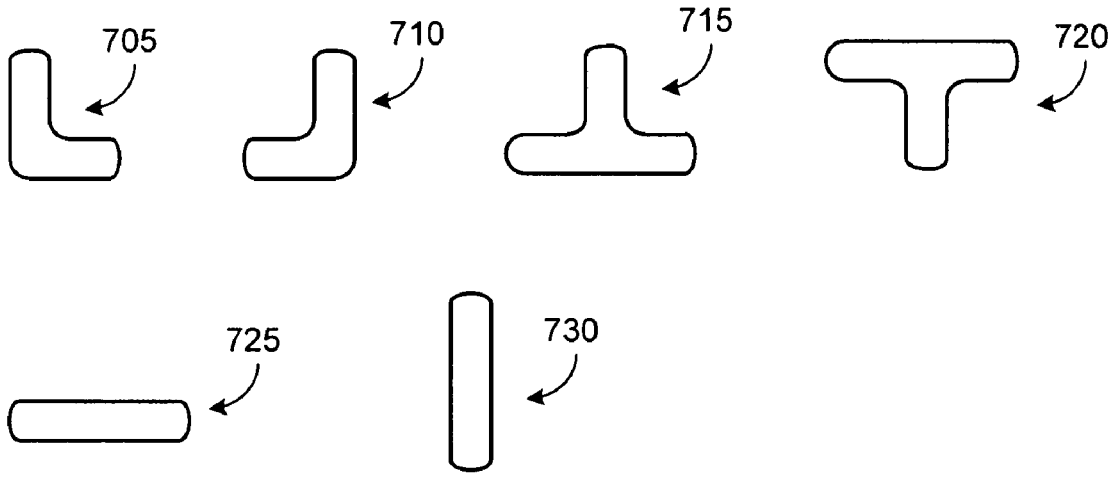
FIG. 9C shows a few exemplary slots that may be used in alternative implementations of a removable mount such as the exemplary ones shown in FIGS. 7 and 9A.

FIG. 9C shows a few exemplary elongate slots that may be used in the second mounting plate described in exemplary embodiments above. Elongate slot 705 is a L-shaped slot, elongate slot 710 is a horizontally-flipped L-shaped slot, elongate slot 715 is an inverted T-shaped slot, elongate slot 720 is a T-shaped slot, elongate slot 725 is a horizontal slot, and elongate slot 730 is a vertical slot.

Figure 10:
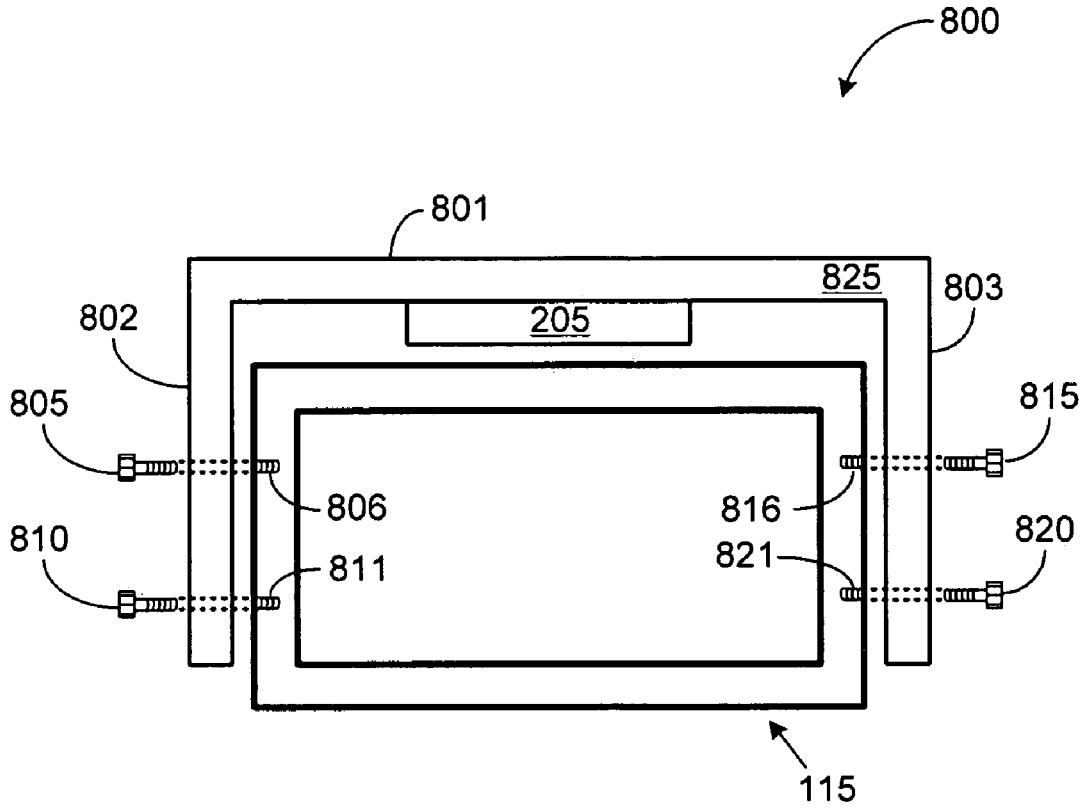
FIG. 10 shows an eighth exemplary embodiment of a removable mount in accordance with the invention.

FIG. 10 shows a eighth exemplary embodiment in accordance with the invention of a removable mount. In this exemplary embodiment, removable mount 800 comprises a removable mounting fixture 825 and one or more threaded bolts, such as threaded bolts 805, 810, 815 and 820.

Removable mounting fixture 825 has a horizontal member 801 and two vertical members 802 and 803 located at the extremities of horizontal member 801. In this exemplary embodiment, an electronic system component, which is RFID reader module 205 in this example, is attached to a bottom surface of horizontal member 801. In other embodiments the electronic system component is attached to other parts of removable mounting fixture 825.

Removable mounting fixture 825 is mounted and anchored to sideshifter 115 using threaded bolts 805, 810, 815 and 820 that are mated to threaded apertures 806, 811, 816 and 821 located in sideshifter 115. In one exemplary embodiment, threaded apertures 806, 811, 816 and 821 are OEM apertures, such as those used for attaching a load rest (not shown) to sideshifter 115. In another embodiment, threaded apertures 806, 811, 816 and 821 are created in an after-market modification of sideshifter 115.

It will be understood that the number of threaded bolts and threaded apertures described above are merely for purposes of description. In various other embodiments, fewer or larger number of threaded bolts and threaded apertures may be used. Other attachment means such as a latch, a collar, a strap, and a clamp may be used alternatively to mount removable mounting fixture 825 upon sideshifter 115.

Figure 11:
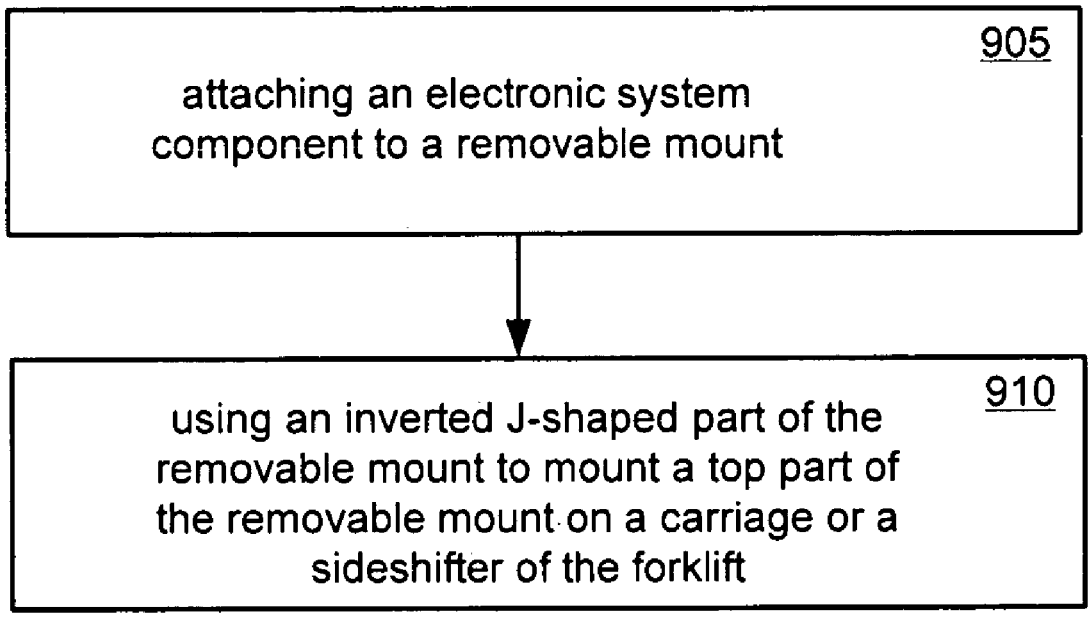
FIG. 11 is a flowchart of an exemplary method of use of a removable mount in accordance with the invention.

FIG. 11 is a flowchart of an exemplary method of mounting an electronic system component on a forklift. In block 905, an electronic system component is attached to a first mounting plate of a removable mount. This is generally performed by mounting the electronic system component on a major surface of the first mounting plate. In block 910, a top portion of the removable mount is mounted on a carriage or a sideshifter of a forklift by using an inverted J-shaped part of the first mounting plate.

In another exemplary method of mounting an electronic system component on a forklift, a threaded bolt is inserted through an aperture in the first mounting plate and the threaded bolt is mated with an aperture in the carriage or the sideshifter of the forklift. In alternative implementations, the aperture may be an OEM aperture or an after-market aperture.

In yet another exemplary method of mounting an electronic system component on a forklift, a second mounting plate of the removable mount is provided. A threaded bolt is inserted through an aperture in the second mounting plate and the threaded bolt is mated with an aperture in the carriage or the sideshifter of the forklift. In alternative implementations, the aperture may be an OEM aperture or an after-market aperture. A top part of the second mounting plate is then attached to a bottom part of the first mounting plate.

In an exemplary method for dismounting the removable mount from the carriage or the sideshifter of the forklift, the dismounting is carried out without leaving behind any residual mounting hardware on the carriage or the sideshifter.

The above-described embodiments are merely set forth for a clear understanding of the principles of the disclosure. Many variations and modifications may be made without departing substantially from the disclosure. All such modifications and variations are included herein within the scope of this disclosure.

We claim:

1. A removable mount for mounting an electronic system component on a forklift, the removable mount comprising:

a mounting plate having a major surface for mounting the electronic system component thereto;

an inverted J-shaped part comprising a top portion of the mounting plate, the inverted J-shaped part adapted for mounting the mounting plate on at least one of an unmodified original equipment manufacture (OEM) carriage of the forklift and an unmodified OEM sideshifter of the forklift; and a slot configured to accommodate a fastener for anchoring the mounting plate to the at least one of the unmodified OEM carriage and the unmodified OEM sideshifter.

2. The removable mount of claim 1, wherein the fastener is operable to effect a removal of the mounting plate from the at least one of the unmodified OEM carriage and the unmodified OEM sideshifter.

3. The removable mount of claim 2, wherein the fastener is a threaded bolt and the slot is configured to accommodate the threaded bolt.

4. The removable mount of claim 1, wherein the mounting plate is configured as a lid of an RFID system component.

5. The removable mount of claim 1, wherein the mounting plate comprises a horizontal flange projecting orthogonal to a major surface of the mounting plate, and the slot is located in the horizontal flange.

6. The removable mount of claim 5, wherein the slot is configured to accommodate a threaded bolt that is mated to a threaded aperture in the at least one of the unmodified OEM carriage and the unmodified OEM sideshifter.

7. The removable mount of claim 6, wherein the threaded aperture is located on a bottom surface of the at least one of the unmodified OEM carriage and the unmodified OEM sideshifter adjacent to a lower horizontal lip of the at least one of the unmodified OEM carriage and the unmodified OEM sideshifter respectively.

8. The removable mount of claim 6, wherein the threaded aperture is located on a bottom surface of the at least one of the unmodified OEM carriage and the unmodified OEM sideshifter.

9. A removable mount for mounting an electronic system component to a forklift, the removable mount comprising:

a first mounting plate having a mounting surface for mounting the electronic system component thereto;

an inverted J-shaped part comprising a top portion of the first mounting plate, the inverted J-shaped part adapted for being mounted on at least one of an unmodified original equipment manufacture (OEM) carriage of the forklift and an unmodified OEM sideshifter of the forklift;

a second mounting plate having an alternative mounting surface for mounting the electronic system component thereto, the second mounting plate containing an elongate slot in a major plane of the second mounting plate, the elongate slot configured to accommodate a securing means for securing the second mounting plate to the at least one of the unmodified OEM carriage and the unmodified OEM sideshifter;

an attaching means to attach the first mounting plate to the second mounting plate after mounting one of the first mounting plate and the second mounting plate upon the at least one of the unmodified OEM carriage and the unmodified OEM sideshifter.

10. The removable mount of claim 9, wherein the elongate slot is at least one of a) a J-slot, b) an inverted-J slot, c) an L slot, d) an inverted-L slot, e) a T-slot, f) an inverted T-slot, g) a horizontal slot, and h) a vertical slot.

11. The removable mount of claim 9, wherein the securing means is a threaded bolt that is mated to a threaded aperture in the at least one of the unmodified OEM carriage and the unmodified OEM sideshifter.

12. The removable mount of claim 9, wherein the attaching means is a threaded bolt coupled to a locknut.

13. The removable mount of claim 12, wherein the threaded bolt is a part of one of a) the first mounting plate and b) the second mounting plate.

14. A method for using a removable mount to removably mount an electronic system component on a forklift, the method comprising:

attaching the electronic system component to a first mounting plate of the removable mount; and using an inverted J-shaped part of the first mounting plate to mount a top portion of the removable mount upon at least one of a carriage and a sideshifter of the forklift.

15. The method of claim 14, wherein the carriage is an unmodified original equipment manufacture (OEM) carriage of the forklift and the sideshifter is an unmodified OEM side shifter.

16. The method of claim 15, further comprising:

inserting a threaded bolt through an aperture in the first mounting plate; and mating the threaded bolt to a threaded aperture in the at least one of the unmodified OEM carriage and the unmodified OEM sideshifter.

17. The method of claim 16, wherein the aperture is located in a horizontal flange projecting orthogonal to a major surface of the first mounting plate.

18. The method of claim 15, further comprising:

providing a second mounting plate of the removable mount;

inserting a threaded bolt through an aperture in the second mounting plate;

mating the threaded bolt to a threaded aperture in the at least one of the unmodified OEM carriage and the unmodified OEM sideshifter; and attaching a top portion of the second mounting plate to a bottom portion of the first mounting plate.

19. The method of claim 18, wherein the step of attaching the top portion of the second mounting plate to the bottom portion of the first mounting plate comprises:

inserting a threaded bolt through an aperture in the second mounting plate; and mating the threaded bolt to a threaded aperture in the first mounting plate.

20. The method of claim 15, further comprising:

dismounting the removable mount from the at least one of the unmodified OEM carriage and the unmodified OEM sideshifter without leaving behind residual mounting hardware on the at least one of the unmodified OEM carriage and the unmodified OEM side shifter.

21. A removable mount for removably mounting an REID system component on a forklift, the removable mount comprising:

an original equipment manufacture (OEM) sideshifter of the forklift, the OEM sideshifter having a threaded aperture;

a threaded bolt;

a mounting fixture having a mounting surface for mounting the REID system component thereto; and a mounting hole located in the mounting fixture, the mounting hole sized to accommodate an insertion of the threaded bolt for mating the threaded bolt to the threaded aperture of the OEM sideshifter.

22. The removable mount of claim 21, wherein the mounting hole is threaded.

23. A removable mount for removably mounting an electronic system component on a forklift, the removable mount comprising:

a mounting plate having a major surface for mounting the electronic system component thereto; and an inverted L-shaped part comprising a top portion of the mounting plate, the inverted L- shaped part having a first mounting hole through which is inserted a first set screw to anchor the mounting plate to an upper horizontal surface of at least one of an unmodified original equipment manufacture (OEM) carriage of the forklift and an unmodified OEM sideshifter of the forklift.

24. The removable mount of claim 23, further comprising:

an L-shaped part comprising a bottom portion of the mounting plate, the L-shaped part having a second mounting hole through which is inserted a second set screw to anchor the mounting plate to a lower horizontal surface of the at least one of an unmodified OEM carriage and the unmodified OEM sideshifter.

25. The removable mount of claim 23, further comprising:

a J-shaped part comprising a bottom portion of the mounting plate, the J-shaped part adapted to engage a lower horizontal lip of the at least one of an unmodified OEM carriage and the unmodified OEM sideshifter.

26. A removable mount for removably mounting an electronic system component on a forklift, the removable mount comprising:

a first mounting plate having a major surface for mounting the electronic system component thereto;

an inverted J-shaped part comprising a top portion of the first mounting plate, the inverted J-shaped part adapted for mounting the first mounting plate on an upper horizontal lip of at least one of an unmodified original equipment manufacture (OEM) carriage of the forklift and an unmodified OEM sideshifter of the forklift; and a J-shaped part comprising a bottom portion of the first mounting plate, the J-shaped part having a first width less than a second width of a notch in a lower horizontal lip of the at least one of an unmodified OEM carriage of the forklift and an unmodified OEM sideshifter of the forklift, the J-shaped part adapted to be inserted through the notch.

27. The removable mount of claim 26, wherein a height of the first mounting plate measured between an inner surface of the inverted J-shaped part and an inner surface of the J-shaped part is approximately equal to a height of the at least one of an unmodified OEM carriage of the forklift and an unmodified OEM sideshifter of the forklift, the height of the at least one of an unmodified OEM carriage of the forklift and an unmodified OEM sideshifter of the forklift being measured from a top surface of the upper horizontal lip and a bottom surface of the lower horizontal lip.

28. The removable mount of claim 26, further comprising:

an aperture located in the inverted J-shaped part, the aperture configured to accommodate a set screw that is inserted through the aperture to engage with an upper surface of the upper horizontal lip.

29. The removable mount of claim 26, further comprising:

a secondary mounting plate adapted to be mounted upon the major surface of the first mounting plate, the secondary mounting plate having a second major surface for mounting the electronic system component thereto.

* * * * *